US007938660B1

(12) United States Patent
Beak et al.

(10) Patent No.: US 7,938,660 B1
(45) Date of Patent: May 10, 2011

(54) CONNECTOR UNIT WITH A MALE CONNECTOR HAVING A CONTROL TERMINAL WITH A SWITCH

(75) Inventors: Seung Seok Beak, Shinagawa (JP); Yasushi Masuda, Shinagawa (JP); Hideo Miyazawa, Shinagawa (JP); Keiichi Hirose, Minato-ku (JP); Tomonori Iino, Minato-ku (JP)

(73) Assignees: Fujitsu Component Limited, Tokyo (JP); NTT Facilities, Inc., Tokyo (JP)

( * ) Notice: Subject to any disclaimer, the term of this patent is extended or adjusted under 35 U.S.C. 154(b) by 0 days.

(21) Appl. No.: 12/842,064

(22) Filed: Jul. 23, 2010

(30) Foreign Application Priority Data

Nov. 13, 2009 (JP) ..... 2009-259730
Nov. 13, 2009 (JP) ..... 2009-259774

(51) Int. Cl.
*H01R 11/22* (2006.01)

(52) U.S. Cl. ..... 439/269.1

(58) Field of Classification Search ..... 439/269.1, 439/489, 188, 353; 318/445
See application file for complete search history.

(56) References Cited

U.S. PATENT DOCUMENTS 5,158,473 A 10/1992 Takahashi et al.
6,042,410 A * 3/2000 Watanabe ..... 439/269.1
6,411,053 B1 * 6/2002 Dewey ..... 318/445
6,568,956 B1 * 5/2003 Holmberg ..... 439/500
7,167,078 B2 * 1/2007 Pourchot ..... 340/5.61
2005/0184856 A1 * 8/2005 Pourchot ..... 340/5.61
2010/0029110 A1 * 2/2010 Kiryu et al. ..... 439/188
2010/0029111 A1 * 2/2010 Yuba et al. ..... 439/188

FOREIGN PATENT DOCUMENTS

JP 04-58479 2/1992
JP 05-82208 4/1993
JP 08-40270 2/1996
JP 10-83863 3/1998
JP 2003-31301 1/2003
JP 2003-142202 5/2003

* cited by examiner

*Primary Examiner* — Chandrika Prasad
(74) *Attorney, Agent, or Firm* — IPUSA, PLLC

(57) ABSTRACT

A connector unit includes a male connector including a control plug terminal, a slide switch for moving the control plug terminal between a first position and a second position in a first direction, a return button protruding from the opening of the slide switch in a second direction perpendicular to the first direction, an urging part to urge the return button in the second direction, and an elastic member; and a female connector including a control jack terminal including a control switch. The control plug terminal is moved to the first position to connect the contacts of the control switch. The return button is pressed with the control plug terminal at the first position to cause the elastic member to deform via the control plug terminal, so that the control plug terminal is moved to the second position with the restoring force of the elastic member.

10 Claims, 37 Drawing Sheets

CONNECTOR UNIT WITH A MALE CONNECTOR HAVING A CONTROL TERMINAL WITH A SWITCH

CROSS-REFERENCE TO RELATED APPLICATIONS

The present application is based upon and claims the benefit of priority of the Japanese Patent Application No. 2009-259730, filed on Nov. 13, 2009, and the Japanese Patent Application No. 2009-259774, filed on Nov. 13, 2009, the entire contents of which are incorporated herein by reference.

BACKGROUND OF THE INVENTION

1. Field of the Invention

The present invention relates to a connector unit and a male connector used to supply electric power.

2. Description of the Related Art

Generally, electronic apparatuses operate with the electric power supplied from a power supply.

Usually, in supplying an electronic apparatus with electric power, the electric power is supplied from a power supply to the electronic apparatus via a connector unit. The connector unit used in this case establishes an electric connection by fitting a male (inserting) connector and a female (receiving) connector to each other as disclosed in, for example, Japanese Laid-Open Patent Application No. 5-82208 and Japanese Laid-Open Patent No. 2003-31301.

In recent years, studies have been made, as a measure against global warming, of supplying direct current, high-voltage electric power in power transmission in local areas as well. Such a form of power supply, which is reduced in power loss in voltage conversion or power transmission and does not require an increase in cable thickness, is considered desirable particularly for information apparatuses such as servers, which consume a large amount of power.

The electric power thus supplied to electric apparatuses may affect human bodies or the operations of electronic components if the voltage is high.

In the case of using such high-voltage electric power for information apparatuses such as servers, there are human operations in the installation or maintenance of the apparatuses. Accordingly, connector units, which establish electrical connections, need to be different from those used for usual alternate-current commercial power supplies.

SUMMARY OF THE INVENTION

According to one aspect of the present invention, a connector unit for electrically connecting a power supply and an electronic apparatus to be supplied with electric power from the power supply includes a male connector to be connected to the electronic apparatus, the male connector including a pair of power plug terminals of conductors for receiving the electric power; a control plug terminal; a slide switch for moving the control plug terminal between a first position and a second position in a first direction; a return button protruding from an opening of the slide switch in a second direction perpendicular to the first direction; an urging part configured to urge the return button in the second direction; and an elastic member; and a female connector to be connected to the power supply, the female connector including a pair of power jack terminals corresponding to the power plug terminals; and a control jack terminal corresponding to the control plug terminal and including a control switch, wherein the control plug terminal is configured to cause contacts of the control switch of the control jack terminal to be connected to allow the electric power to be supplied to the electronic apparatus, by being moved to the first position with the power plug terminals being fit into the jack plug terminals, and the return button is configured to cause the elastic member to deform via the control plug terminal by being pressed with the control plug terminal at the first position, so that the control plug terminal is moved to the second position with a restoring force of the elastic member.

According to one aspect of the present invention, a male connector configured to be connected to an electronic apparatus and a female connector to be connected to a power supply, in order to electrically connect the power supply and the electronic apparatus to be supplied with electric power from the power supply, includes a pair of power plug terminals of conductors for receiving the electric power; a control plug terminal; a slide switch for moving the control plug terminal between a first position and a second position in a first direction; a return button protruding from an opening of the slide switch in a second direction perpendicular to the first direction; an urging part configured to urge the return button in the second direction; and an elastic member, wherein the control plug terminal is configured to cause contacts of a control switch of a control jack terminal of the female connector to be connected to allow the electric power to be supplied to the electronic apparatus, by being moved to the first position with the power plug terminals being fit into jack plug terminals of the female connector, and the return button is configured to cause the elastic member to deform via the control plug terminal by being pressed with the control plug terminal at the first position, so that the control plug terminal is moved to the second position with a restoring force of the elastic member.

According to one aspect of the present invention, a connector unit for electrically connecting a power supply and an electronic apparatus to be supplied with electric power from the power supply includes a male connector to be connected to the electronic apparatus, the male connector including a pair of power plug terminals of conductors for receiving the electric power; and a control plug terminal of a conductor configured to be movable between a first position and a second position in a first direction, the control plug terminal including a step part protruding in a second direction perpendicular to the first direction; and a female connector to be connected to the power supply, the female connector including a pair of power jack terminals corresponding to the power plug terminals; a control jack terminal including a pair of control electrodes; and an engagement claw configured to engage and disengage from the step part, wherein the control plug terminal is configured to cause the control electrodes to be electrically connected so that the electric power is supplied from the power supply to the electronic apparatus, and to have the step part thereof engage the engagement claw, by being moved to the first position with the power plug terminals being fit into the jack plug terminals.

According to one aspect of the present invention, a male connector configured to be connected to an electronic apparatus and a female connector to be connected to a power supply, in order to electrically connect the power supply and the electronic apparatus to be supplied with electric power from the power supply, includes a pair of power plug terminals of conductors for receiving the electric power; and a control plug terminal of a conductor configured to be movable between a first position and a second position in a first direction, the control plug terminal including a step part protruding in a second direction perpendicular to the first direction, wherein the control plug terminal is configured to cause a pair of control electrodes of a control jack terminal of the female connector to be electrically connected so that the electric power is supplied from the power supply to the electronic apparatus, and to have the step part thereof engage an engagement claw of the female connector, by being moved to the first position with the power plug terminals being fit into jack plug terminals of the female connector.

The object and advantages of the embodiments will be realized and attained by means of the elements and combinations particularly pointed out in the claims.

It is to be understood that both the foregoing general description and the following detailed description are exemplary and explanatory and not restrictive of the invention, as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

[a] First Embodiment

A description is given of a connector unit, a male connector, and a female connector according to a first embodiment of the present invention.

Figure 1:
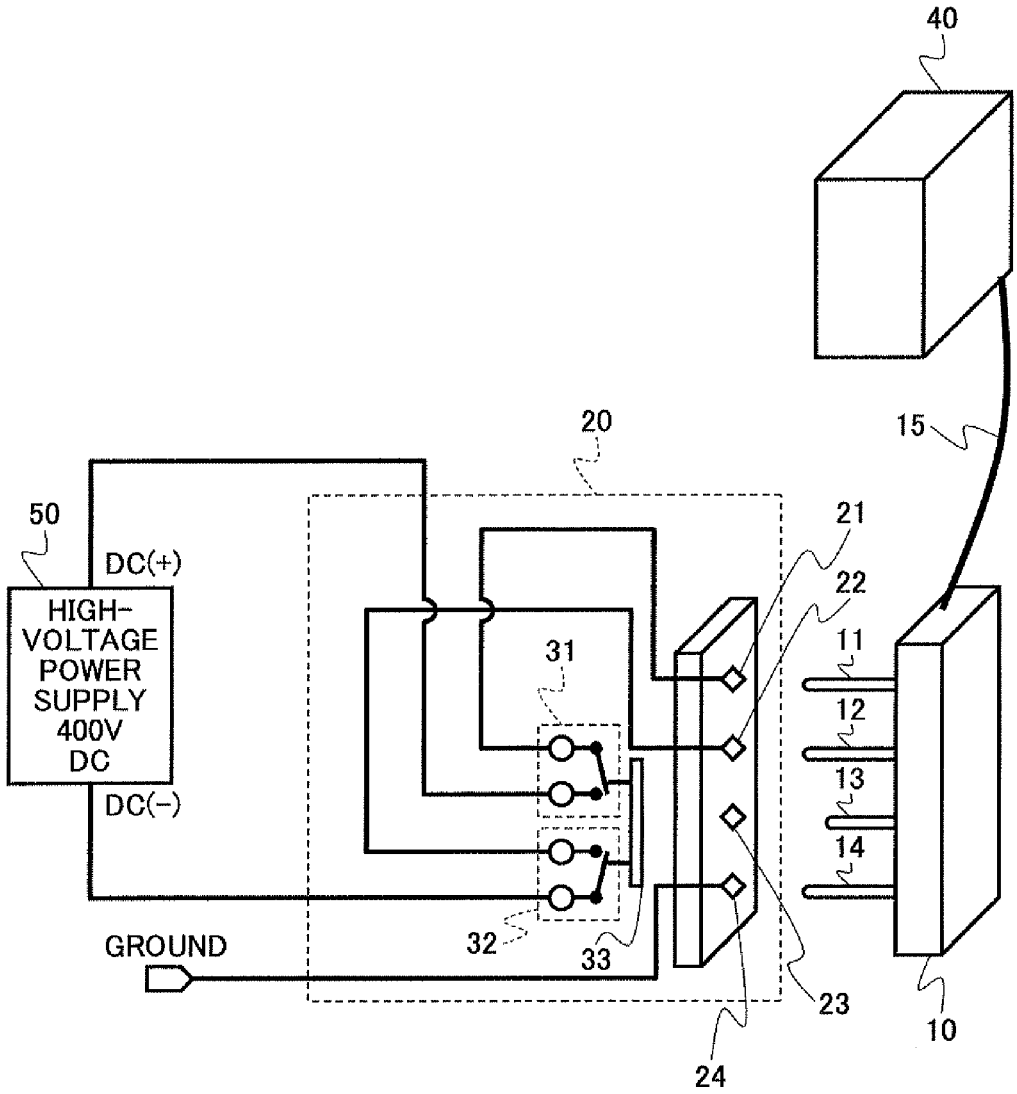
FIG. 1 is a diagram illustrating a configuration of a connector unit according to a first embodiment of the present invention.

FIG. 1 is a schematic diagram illustrating a configuration of a connector unit, a configuration of a male connector, and a configuration of a female connector according to the first embodiment.

According to this embodiment, a connector unit includes a male connector 10 and a female connector 20. The male connector 10 is connected to an information apparatus 40 (an electronic apparatus) such as a server via a power supply cable 15. The male connector 10 includes two power plug terminals 11 and 12 for receiving a supply of electric power, a control plug terminal 13, and a ground plug terminal 14 for grounding. The control plug terminal 13 is configured to be movable back and forth relative to the insertion direction of the male connector 10 (in which the male connector 10 is inserted into the female connector 20) so as to extend in the insertion direction from a housing 10*a* (FIGS. 2A through 2C) of the male connector 10 and retract in the opposite direction (in which the male connector 10 is detached or removed from the female connector 20) into the housing 10*a*.

On the other hand, the female connector 20 is connected to a high-voltage power supply 50 for supplying electric power. The female connector 20 includes power jack terminals 21 and 22 corresponding to the power plug terminals 11 and 12, respectively, a control jack terminal 23 corresponding to the control plug terminal 13, and a ground jack terminal 24 corresponding to the ground plug terminal 14.

Further, the female connector 20 includes two control switches 31 and 32. These control switches 31 and 32 include a leaf-spring switch, which is pressed down to cause respective contacts to come into contact with each other so as to allow electric current to flow. According to this embodiment, a leaf spring 33 of an insulator is provided immediately above the control switches 31 and 32.

The control switch 31 has one of its terminals connected to the positive output of the high-voltage power supply 50 and has the other one of its terminals connected to the power jack terminal 21. The control switch 32 has one of its terminals connected to the negative output of the high-voltage power supply 50 and has the other one of its terminals connected to the power jack terminal 22.

These control switches 31 and 32 are configured to have respective contacts connected (closed) via the leaf spring 33 of an insulator by extending the control plug terminal 13 of the male connector 10 in its insertion direction in the state where the male connector 10 and the female connector 20 are fit to each other.

The contacts of the control switches 31 and 32 are thus connected so that the power jack terminals 21 and 22 of the female connector 20 are supplied with electric power, which is further supplied to the information apparatus 40 such as a server via the power plug terminals 11 and 12 of the male connector 10.

In the connector unit of this embodiment, the control switches 31 and 32 are connected to the power jack terminals 21 and 22, respectively. In the case of high-voltage direct-current (DC) electric power of a voltage exceeding 48 V, for example, a voltage higher than or equal to 200 V, contacting electricity is extremely dangerous to human bodies. Therefore, the control switches 31 and 32 are connected to the power jack terminals 21 and 22, respectively, to control the electric power supply from the power jack terminals 21 and 22, thereby further increasing safety.

According to embodiments of the present invention, the control jack terminal 23 may be configured to include inside a control switch whose ON and OFF are controlled by a dynamic force due to the extending and the retracting movement of the control plug terminal 13.

Next, a description is given, with reference to FIGS. 2A through 2C, FIGS. 3A through 3F, and FIG. 4, of a structure of the male connector 10 of this embodiment.

Figure 2A:
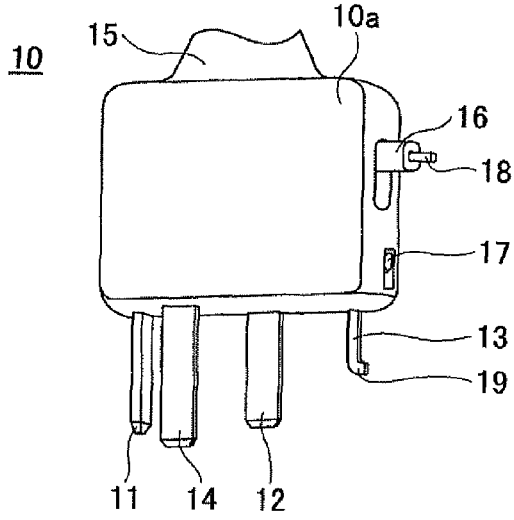
FIGS. 2A through 2C are perspective views of the exterior of a male connector according to the first embodiment of the present invention.
Figure 2B:
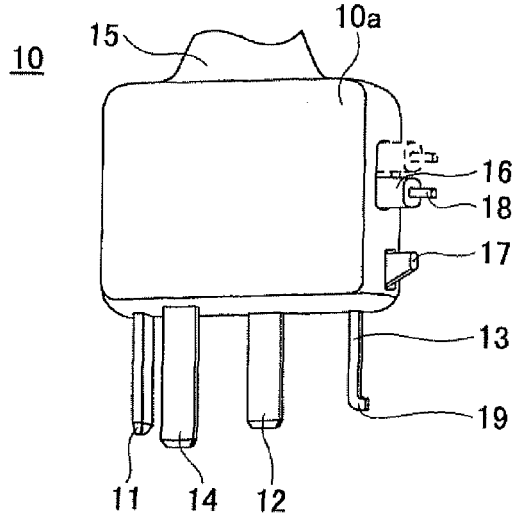
Figure 2C:
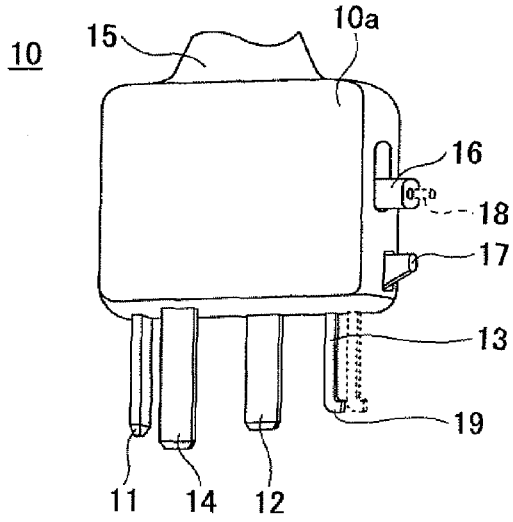

FIGS. 2A through 2C are diagrams illustrating a configuration of the male connector 10. FIG. 2A is a perspective view of the male connector 10 with the control plug terminal 13 in a retracted state. FIG. 2B is a perspective view of the male connector 10 with the control plug terminal 13 in an extended state. FIG. 2C is a perspective view of the male connector 10 with the control plug terminal 13 in the extended state and a return button 18 in a pressed state.

According to this embodiment, the male connector 10 includes a slide switch 16, a lock terminal 17, and the return button 18 in addition to the above-described two power plug terminals 11 and 12 for receiving a supply of electric power, control plug terminal 13, and ground plug terminal 14 for grounding. The return button 18 protrudes from the opening of the slide switch 16 in a direction perpendicular to the insertion direction of the male connector 10. The return button 18 is urged in the protruding direction by an urging part (not graphically illustrated).

Sliding the slide switch 16 in the insertion direction of the control plug terminal 13 from the position illustrated in FIG. 2A to the position illustrated in FIG. 2B causes the control plug terminal 13 to extend and causes the lock terminal 17 to protrude. Further, pressing the return button 18 from the position illustrated in FIG. 2B to the position illustrated in FIG. 2C causes the control plug terminal 13 to move in a direction perpendicular to the insertion direction.

According to this embodiment, the control plug terminal 13 is caused to slide back and forth in the insertion direction and the lock terminal 17 is caused to protrude using the slide switch 16. Alternatively, the control plug terminal 13 may be caused to slide back and forth in the insertion direction and the lock terminal 17 may be caused to protrude using a push button movable in the directions perpendicular to the insertion direction in place of the slide switch 16.

Next, a description is given, with reference to FIGS. 3A through 3D, of the case of extending the control plug terminal 13 in the male connector 10 according to this embodiment. Extending the control plug terminal 13 causes the contacts of each of the control switches 31 and 32 provided at the control jack terminal 23 of the female connector 20 to change from an open state to a closed state.

Figure 3A:
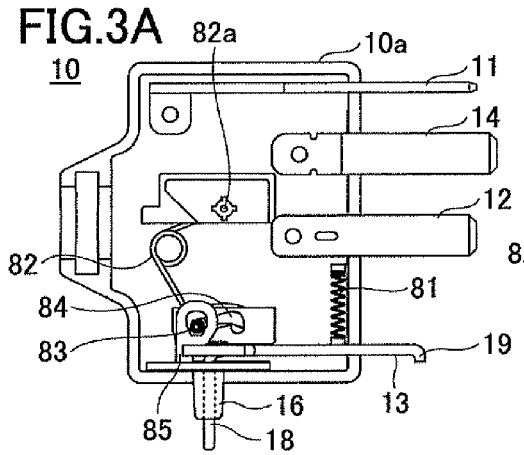
FIGS. 3A through 3F are diagrams illustrating the case of extending and retracting a control plug terminal of the male connector according to the first embodiment of the present invention.

FIG. 3A is an internal structural view of the male connector 10 with the control plug terminal 13 in the retracted state. FIG. 33 is an inside perspective view of the male connector 10 with the control plug terminal 13 in the retracted state.

Figure 3B:
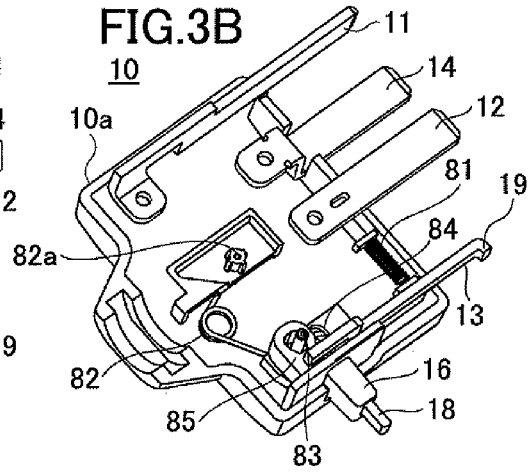
Figure 3C:
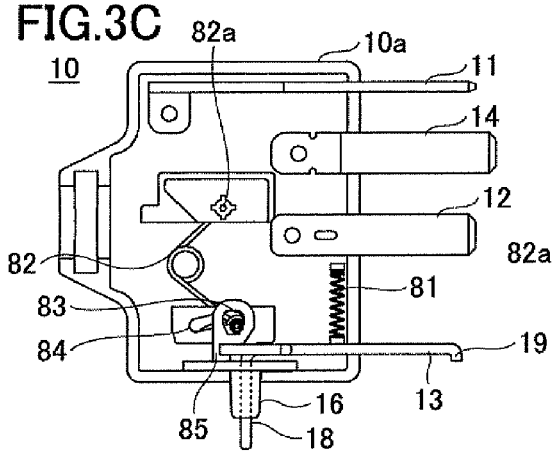
Figure 3D:
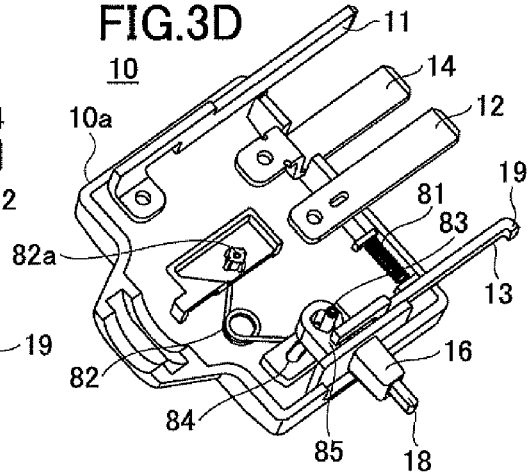

FIG. 3C is an internal structural view of the male connector 10 with the control plug terminal 13 in the extended state before the return button 18 is pressed. FIG. 3D is an inside perspective view of the male connector 10 with the control plug terminal 13 in the extended state before the return button 18 is pressed.

As illustrated in FIGS. 3A and 3B, the slide switch 16 is configured to cause the control plug terminal 13 to extend via the return button 18. A coil spring 81 is connected to the control plug terminal 13. The coil spring 81 is slightly compressed. The restoring force of the coil spring 81 urges the return button 18 in the protruding direction via the control plug terminal 13. According to this embodiment, the control plug terminal 13 and the return button 18 are formed as a unitary structure.

Further, a helical torsion coil spring 82 is provided inside the male connector 10. This helical torsion coil spring 82 has one end 82*a* rotatably supported by the housing 10*a* of the male connector 10 and has another end rotatably connected to a cam shaft 83. This cam shaft 83 is inserted in a cylindrical part 85 of the slide switch 16 and is movable inside a cam groove 84.

With the control plug terminal 13 in the retracted state, the slide switch 16 is positioned on the left side, and the cam shaft 83 is positioned furthest to the left inside the cam groove 84 to be in contact with the left-side inner wall surface of the cylindrical part 85 in FIG. 3A. At this point, the helical torsion coil spring 82 is slightly closed (bent) (that is, the legs of the helical torsion coil spring 82 are slightly closed) compared with its natural state.

Moving the slide switch 16 in the insertion direction (rightward in FIG. 3A) thereafter causes the control plug terminal 13 to be pushed to the right side by the return button 18 to move rightward, and causes the cam shaft 83 to be pushed to the right side by the cylindrical part 85 to move rightward in the cam groove 84. With this, the helical torsion coil spring 82 is further closed (bent). The restoring force of the helical torsion coil spring 82 is maximized immediately before the cam shaft 83 moves furthest to the right inside the cam groove 84. When the cam shaft 83 moves furthest to the right inside the cam groove 84, the helical torsion coil spring 82 is restored (opened) to the state illustrated in FIGS. 3C and 3D.

In this state, the slide switch 16 has moved to the right side and the control plug terminal 13 also has moved to the right side in FIG. 3C. Further, the cam shaft 83 has moved furthest to the right inside the cam groove 84 to be in contact with the right-side inner wall surface of the cylindrical part 85. At this point, the helical torsion coil spring 82 is slightly closed (bent) compared with its natural state.

Thereby, it is possible to extend the control plug terminal 13 in the insertion direction. This is performed against the restoring force of the helical torsion coil spring 82.

Next, a description is given, with reference to FIGS. 3A through 3F and FIG. 4, of the case of retracting the control plug terminal 13 in the male connector 10 according to this embodiment. Retracting the control plug terminal 13 causes the contacts of each of the control switches 31 and 32 provided at the control jack terminal 23 of the female connector 20 to change from the closed state to the open state.

Figure 3E:
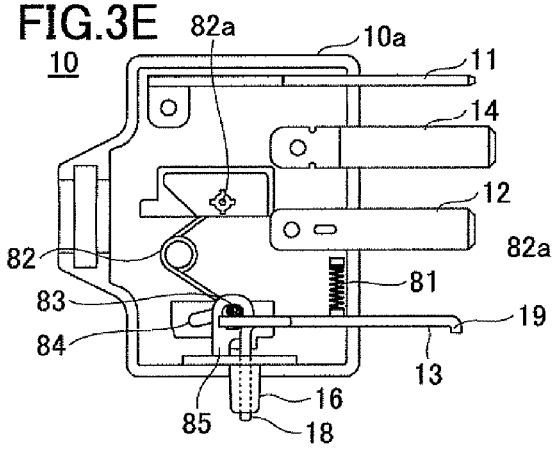
Figure 3F:
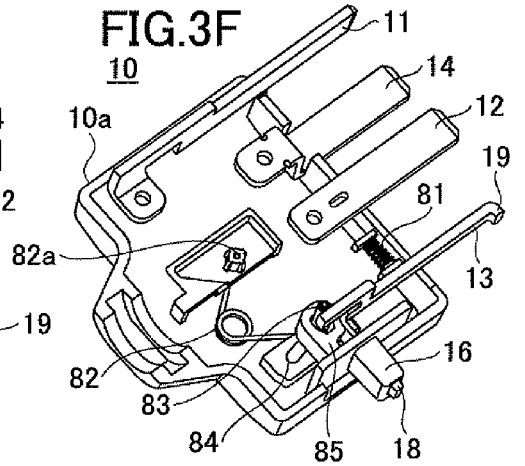
Figure 4:
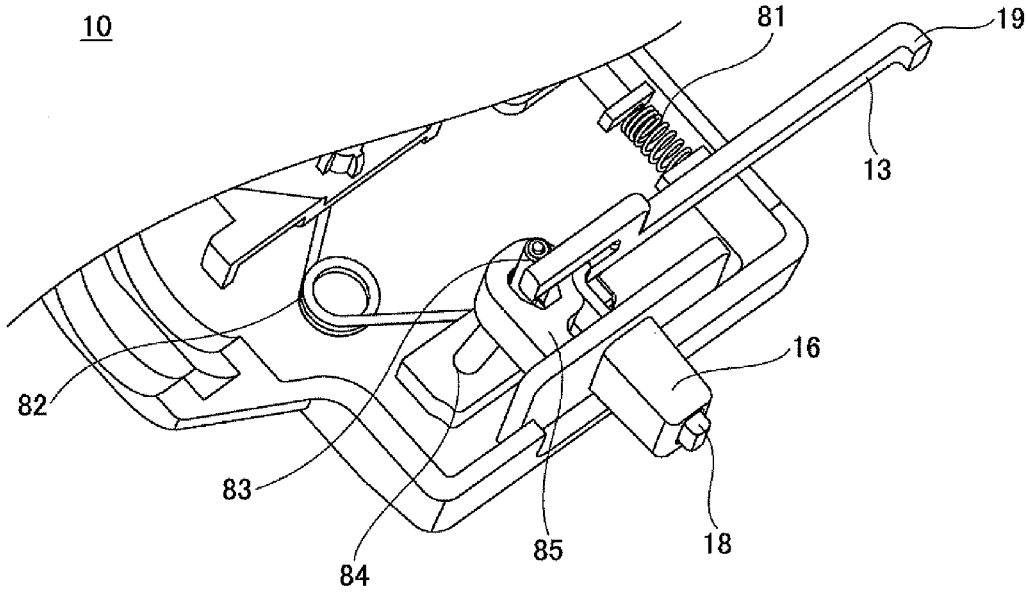
FIG. 4 is a perspective view of an internal structure of the male connector according to the first embodiment of the present invention.

FIG. 3E is an internal structural view of the male connector 10 with the control plug terminal 13 in the extended state and the return button 18 in the pressed state. FIG. 3F is an inside perspective view of the male connector 10 with the control plug terminal 13 in the extended state and the return button 18 in the pressed state. Further, FIG. 4 is an enlarged view of part of FIG. 3F.

As illustrated in FIGS. 3C and 3D, with the control plug terminal 13 in the extended state, the slide switch 16 is positioned on the right side, and the cam shaft 83 is positioned furthest to the right inside the cam groove 84 to be in contact with the right-side inner wall surface of the cylindrical part 85. At this point, the helical torsion coil spring 82 is slightly closed (bent) compared with its natural state.

Pressing the return button 18 thereafter brings about the state illustrated in FIGS. 3E and 3F.

In this state, the control plug terminal 13 is pushed to the upper side by the return button 18 to move upward in FIG. 3E while being in the extended state. At this point, the cam shaft 83 is pushed to the upper side by the side face of the control plug terminal 13 to move upward inside the cam groove 84. In this state, the helical torsion coil spring 82 is further closed (bent) compared with the state illustrated in FIGS. 3C and 3D, so that the restoring force of the helical torsion coil spring 82 is increased.

Thereafter, the opening restoring force of the helical torsion coil spring 82 causes the cam shaft 83 to move leftward inside the cam groove 84 in FIG. 3E to bring about the state illustrated in FIGS. 3A and 3B.

That is, the opening restoring force of the helical torsion coil spring 82 causes the cam shaft 83 to move leftward inside the cam groove 84 in FIG. 3E. As a result, the left-side inner wall surface of the cylindrical part 85 of the slide switch 16 is pressed, so that the control plug terminal 13 is retracted in the direction opposite to the insertion direction via the return button 18.

In this state, the slide switch 16 has moved to the left side and the control plug terminal 13 also has moved to the left side in FIG. 3A. Further, the cam shaft 83 has moved furthest to the left inside the cam groove 84 to be in contact with the left-side inner wall surface of the cylindrical part 85. At this point, the helical torsion coil spring 82 is slightly open compared with the state illustrated in FIGS. 3C and 3D.

Thereby, it is possible to retract the control plug terminal 13 in the direction opposite to the insertion direction. This is performed in a short period of time because the control plug terminal 13 is retracted in the direction opposite to the insertion direction by the restoring force of the helical torsion coil spring 82, that is, the opening force of the helical torsion coil spring 82.

In FIGS. 3A through 3F and FIG. 4, the lock terminal 17 is not illustrated for convenience of graphical representation.

In the case of a configuration without this helical torsion coil spring 82, the control plug terminal 13 would be retracted in the direction opposite to the insertion direction only with the force executed by a human finger. However, the speed of retraction differs depending on a person, and may be low.

In such a case, the low retraction speed of the control plug terminal 13 would cause an arc or chattering to be generated at the contacts of the female connector 20 connected by this control plug terminal 13. Such generation of an arc or chattering would damage the contacts of the female connector 20 or damage an apparatus connected to the male connector 10.

According to the male connector 10 of this embodiment, it is possible to retract the control plug terminal 13 in a short period of time. Accordingly, it is possible to reduce or prevent such generation of an arc or chattering, so that it is possible to reduce or prevent damage to the contacts of the female connector 20 and to prevent damage to an apparatus connected to the male connector 10.

In this embodiment, a description is given of sliding forward and backward (extending and retracting) the control plug terminal 13 using the restoring force of the helical torsion coil spring 82 that works in a direction to open (the legs of) the helical torsion coil spring 82 in a closed (bent) state. Alternatively, it is also possible to extend and retract the control plug terminal 13 in the same manner using the restoring force of the helical torsion coil spring 82 that works in a direction to close (bend) the helical torsion coil spring 82 in an open state by changing the structure of the cam groove 84, etc. Further, the helical torsion coil spring 82 used in this embodiment may be replaced with an elastic body of any configuration as long as the elastic body acts the same.

Next, a description is given, with reference to FIGS. 5A and 5B and FIGS. 6A through 6C, of a structure of the female connector 20 according to this embodiment.

Figure 5A:
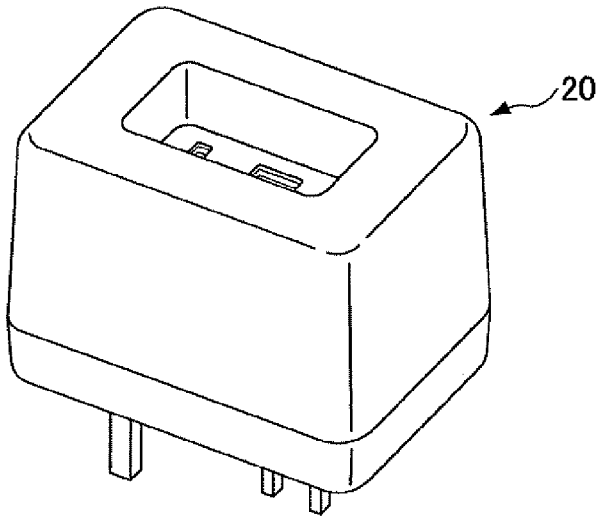
FIGS. 5A and 5B are diagrams illustrating the exterior of a female connector according to the first embodiment of the present invention.

FIG. 5A is a perspective view of the exterior of the female connector 20 according to this embodiment. FIG. 58 is a plan view of the exterior of the female connector 20 according to this embodiment.

Figure 6A:
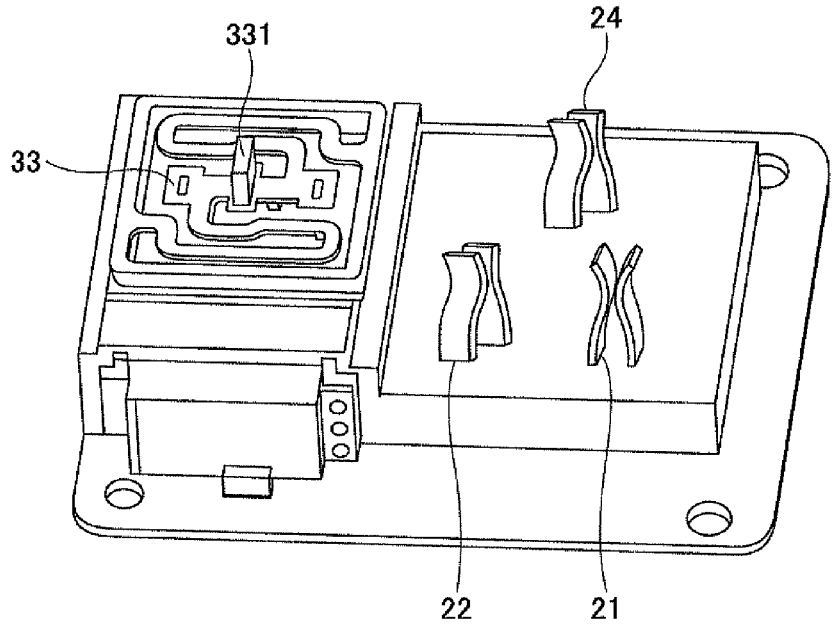
FIGS. 6A through 6C are diagrams illustrating an internal structure of the female connector according to the first embodiment of the present invention.

FIG. 6A is a perspective view of an internal structure of the female connector 20 according to this embodiment. FIG. 68 is a side view of the internal structure of the female connector 20 according to this embodiment, illustrating part thereof in a cross section. FIG. 6C is a front view of the internal structure of the female connector 20 according to this embodiment, illustrating part thereof in a cross section.

Figure 5B:
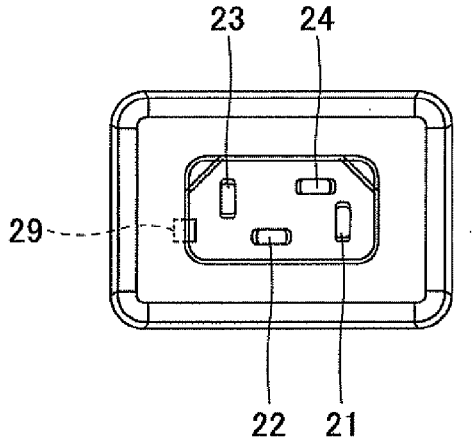

As illustrated in FIGS. 5A and 5B, the female connector 20 according to this embodiment is configured so that part of the body (housing 10*a*) of the male connector 10 is fit into the female connector 20. The female connector 20 includes the power jack terminals 21 and 22 to be connected to the power plug terminals 11 and 12, respectively; the ground jack terminal 24 to be connected to the ground plug terminal 14; the control jack terminal 23 to be connected to the control plug terminal 13 in the extended state; and a recess 29 having a shape corresponding to the lock terminal 17 in a protruding state. With the lock terminal 17 protruding, the male connector 10 and the female connector 20 are prevented from being disjoined because of the recess 29.

Figure 6B:
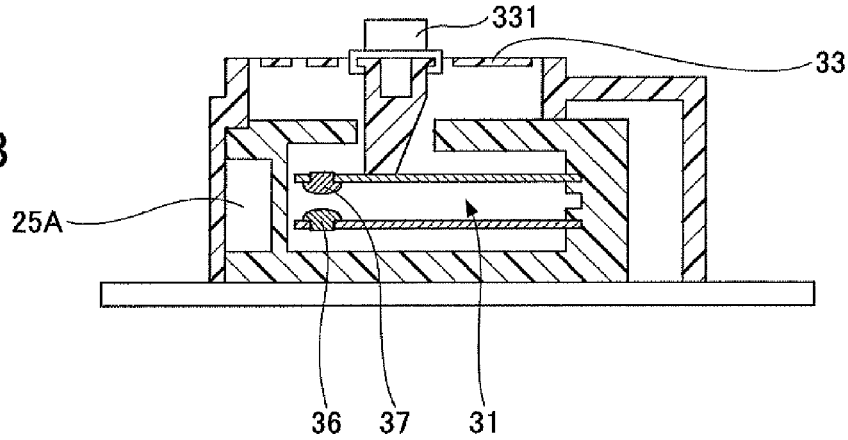
Figure 6C:
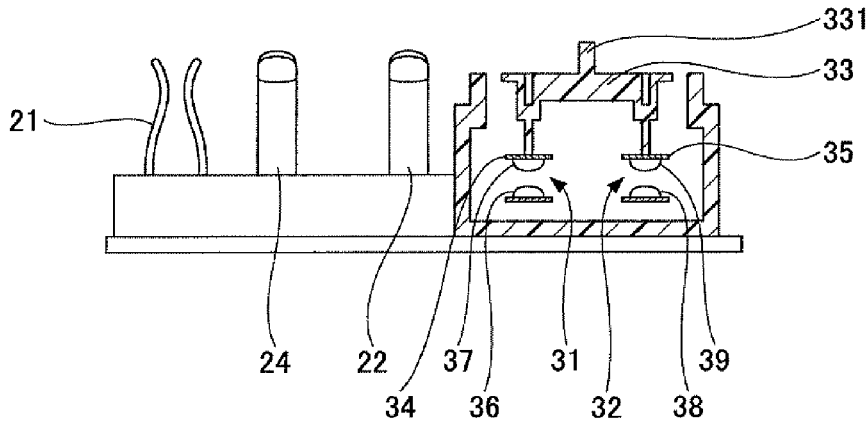

FIGS. 6A through 6C are internal structural diagrams of the female connector 20. The two control switches 31 and 32 are provided inside the control jack terminal 23 of the female connector 20. The leaf spring 33 of an insulator provided above these two control switches 31 and 32 is pressed from above to bend and deform so that the respective contacts of the two control switches 31 and 32 come into contact to allow electric current to flow. The current that flows at this point is 400 VDC. Therefore, it is dangerous to cause the end of the control plug terminal 13 of the male connector 10 to directly press the two control switches 31 and 32 to bring their respective contacts into contact with each other. Accordingly, the respective contacts of the two control switches 31 and 32 are caused to come into contact with each other by the control plug terminal 13 through the leaf spring 33 of an insulator. According to this embodiment, permanent magnets 25A and 25B (see, for example, FIG. 9A) are provided near the respective contacts of the control switches 31 and 32 in order to prevent arcing.

Next, a description is given, with reference to FIGS. 7A through 7D and FIGS. 8A through 8C, of a method of connecting the male connector 10 and the female connector 20 according to this embodiment.

FIGS. 7A through 7D are schematic diagrams illustrating a method of connecting the male connector 10 and the female connector 20 in a view from the front side. FIGS. 8A through 8C are schematic diagrams illustrating the method of connecting the male connector 10 and the female connector 20 in a view from one side. In FIGS. 8A through 8C, some elements such as the power plug terminals 11 and 12 and the ground plug terminal 14 are not graphically illustrated in order to make the drawings easier to understand.

Figure 7A:
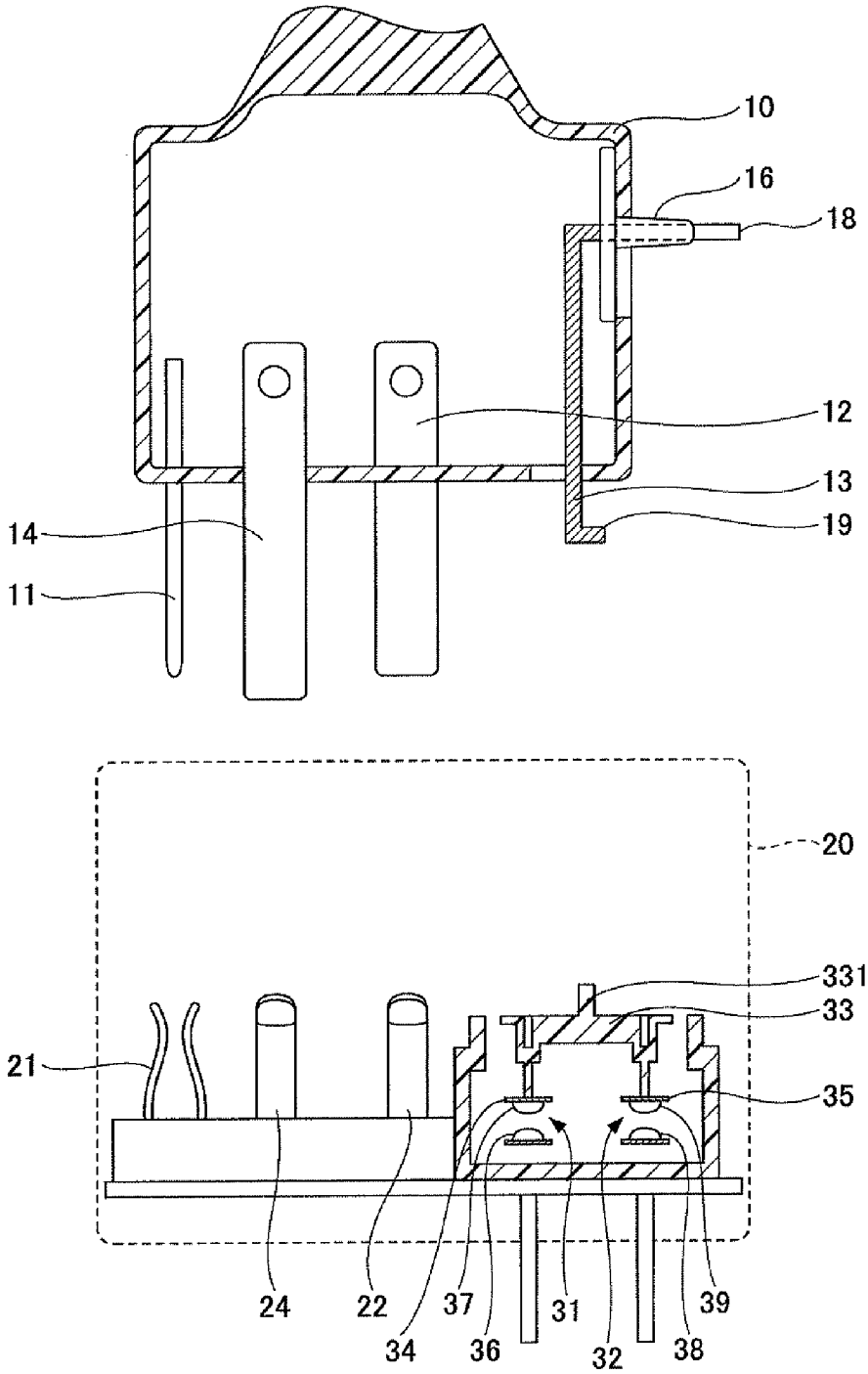
FIGS. 7A through 7D are diagrams illustrating a connecting method of the connector unit according to the first embodiment of the present invention.
Figure 8A:
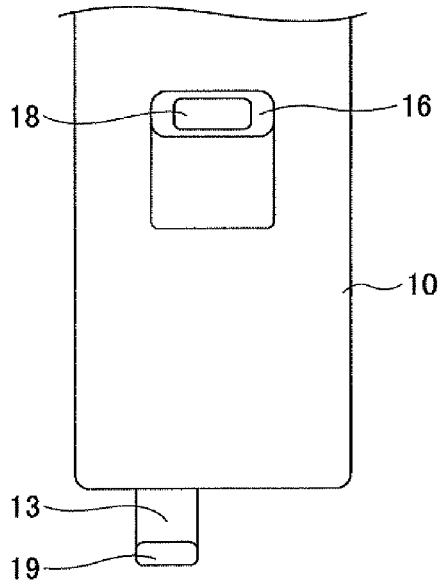
FIGS. 8A through 8C are diagrams illustrating the connecting method of the connector unit according to the first embodiment of the present invention.
Figure 8A:
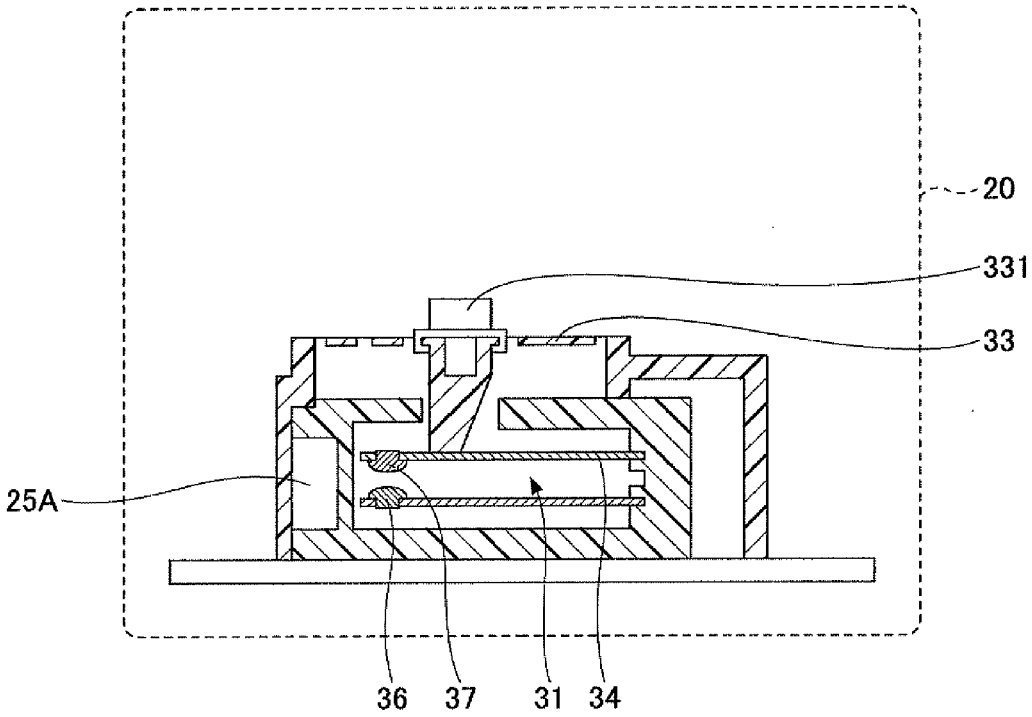
Figure 8B:
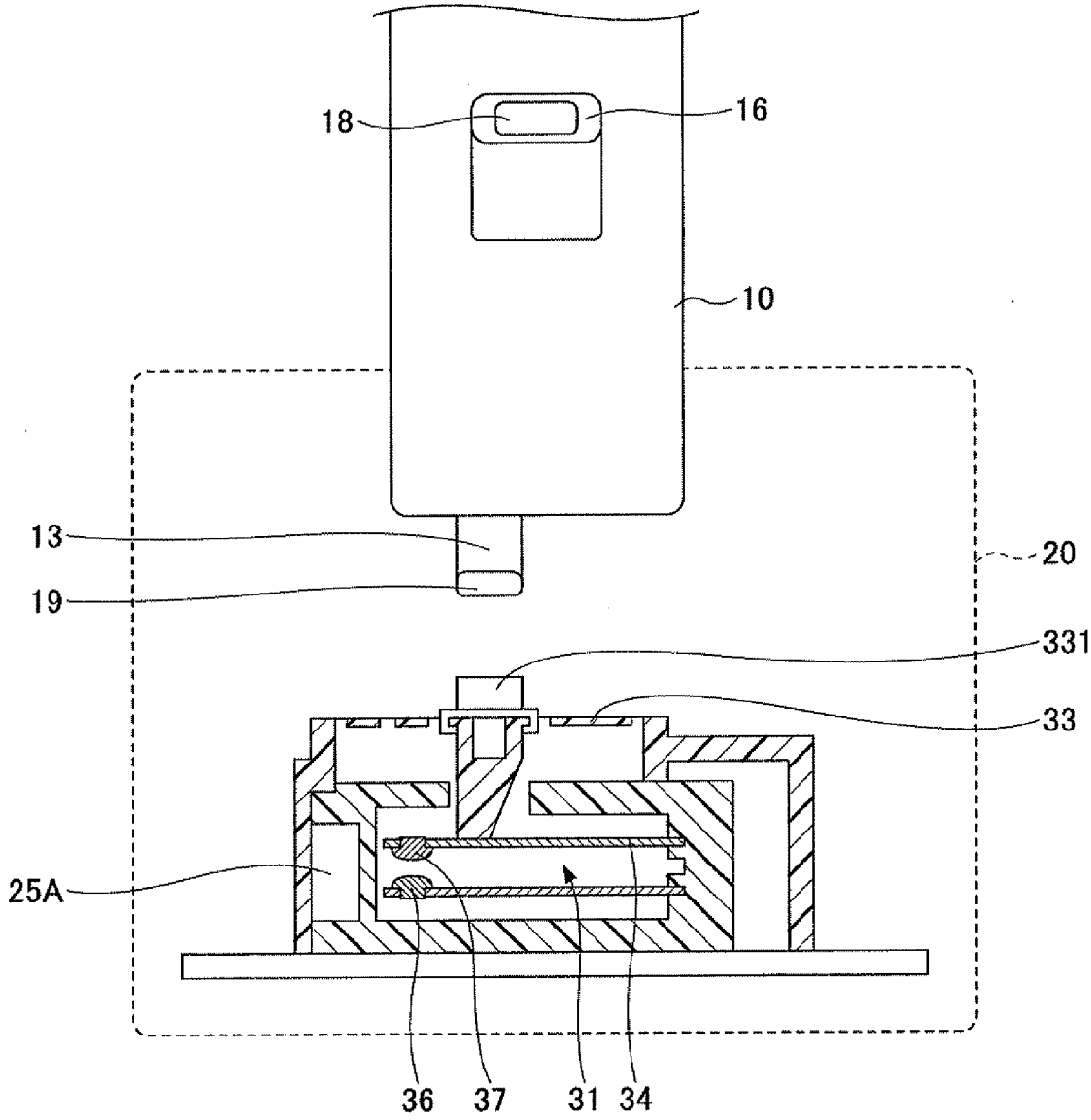
Figure 8C:
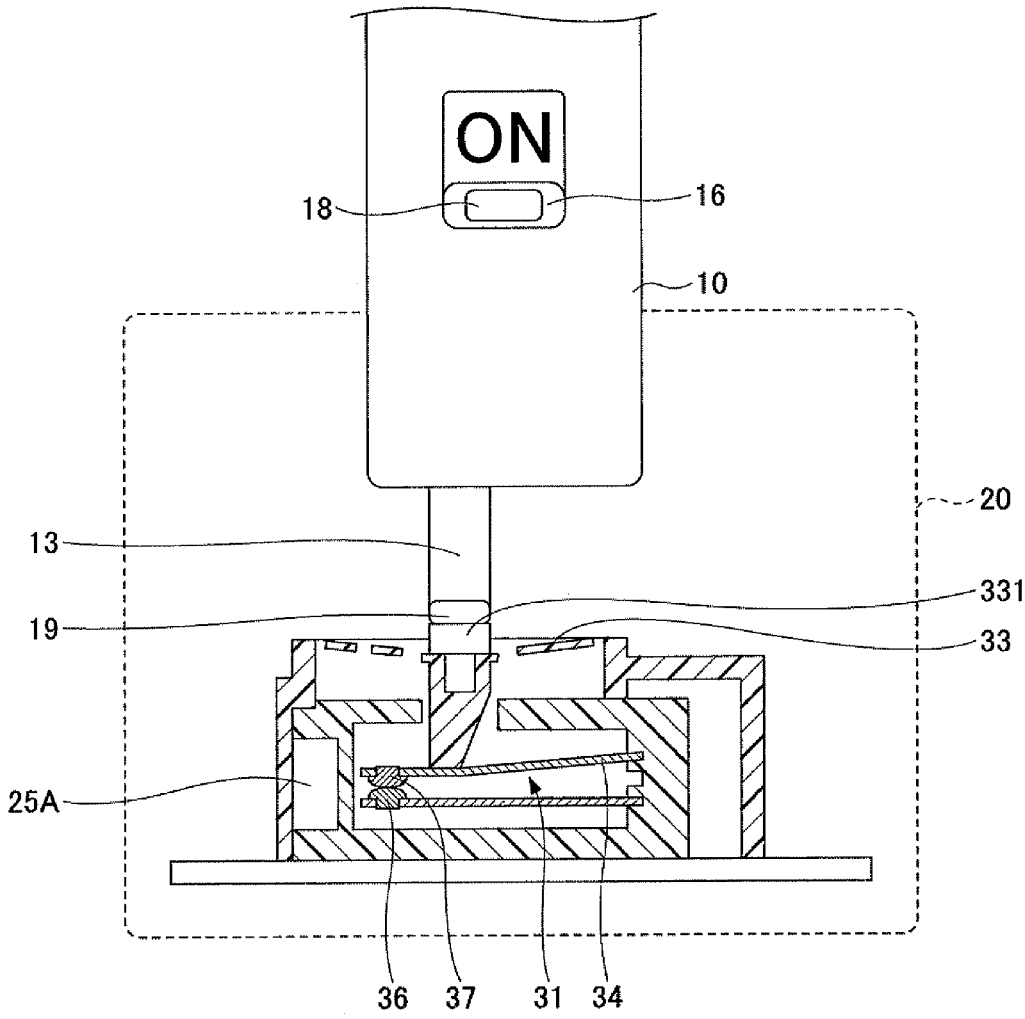

First, FIG. 7A and FIG. 8A illustrate a state before the male connector 10 and the female connector 20 are connected. In this state, the power plug terminal 11 of the male connector 10 and the power jack terminal 21 of the female connector 20 are not connected. Likewise, the power plug terminal 12 and the power jack terminal 22 are not connected, and the ground plug terminal 14 and the ground jack terminal 24 are not connected. Further, the control plug terminal 13 is retracted with the slide switch 16 for extending and retracting the control plug terminal 13 being in a state before being moved in the insertion (downward) direction. The control plug terminal 13 includes a step part 19 at its end, which protrudes in a direction perpendicular to the insertion direction.

On the other hand, in the female connector 20, the control switch 31 and the power jack terminal 21 are connected. The control switch 31 includes a leaf spring part 34 and contacts 36 and 37. The contact 36 is connected to the power jack terminal 21. The leaf spring part 34 is formed like a metal leaf spring. The contact 37 is connected to the high-voltage power supply 50 via the leaf spring part 34. Likewise, the control switch 32 and the power jack terminal 22 are connected. The control switch 32 includes a leaf spring part 35 and contacts 38 and 39. The contact 38 is connected to the power jack terminal 22. The leaf spring part 35 is formed like a metal leaf spring. The contact 39 is connected to the high-voltage power supply 50 via the leaf spring part 35.

The leaf spring 33 of an insulator provided above the control switches 31 and 32 bends and deforms in response to application of a force from above the leaf spring 33 so as to transmit the force to the control switches 31 and 32. The leaf spring 33 includes a protruding part 331 that protrudes (upward) parallel to the insertion direction.

Figure 7B:
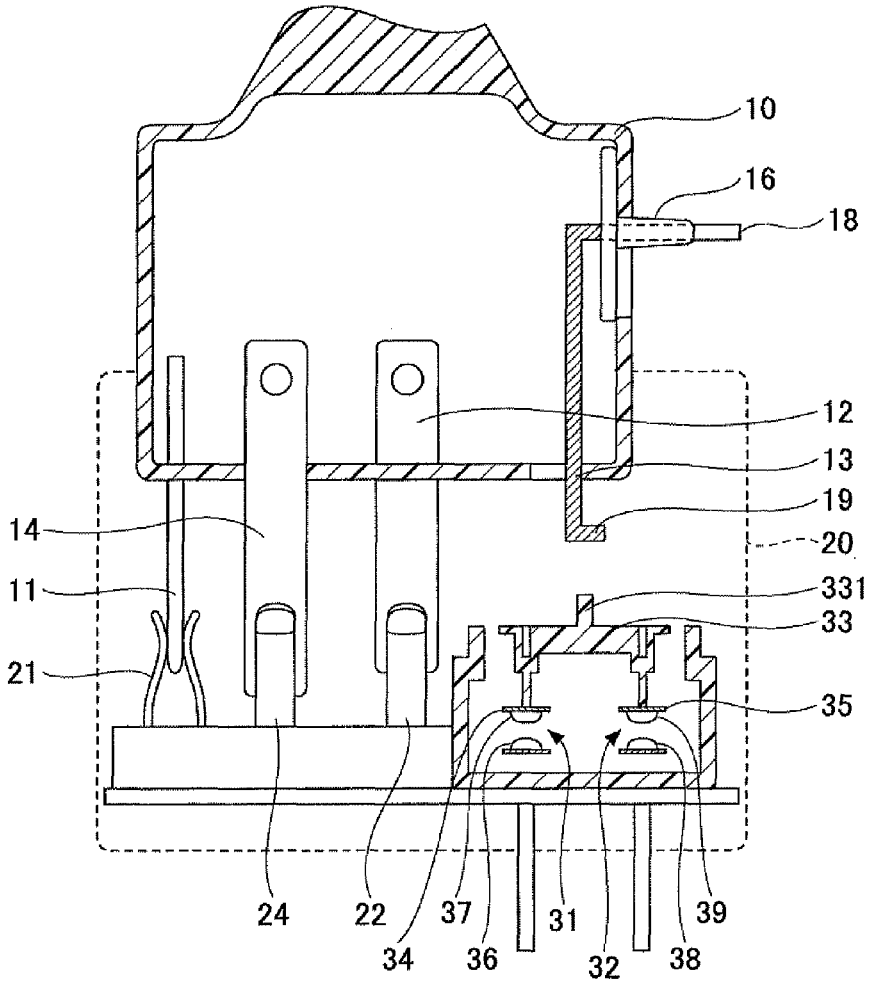

FIG. 7B and FIG. 8B are diagrams illustrating a state where the male connector 10 is inserted in the female connector 20. In this state, the power plug terminal 11 of the male connector 10 is fit into the power jack terminal 21 of the female connector 20. Likewise, the power plug terminal 12 is fit into the power jack terminal 22, and the ground plug terminal 14 is fit into the ground jack terminal 24. In this state, the control plug terminal 13 remains retracted with the slide switch 16 for extending and retracting the control plug terminal 13 still in the state before being moved in the insertion (downward) direction. Accordingly, in the female connector 20, the contacts 36 and 37 of the control switch 31 are out of contact, and the contacts 38 and 39 of the control switch 32 also are out of contact.

Figure 7C:
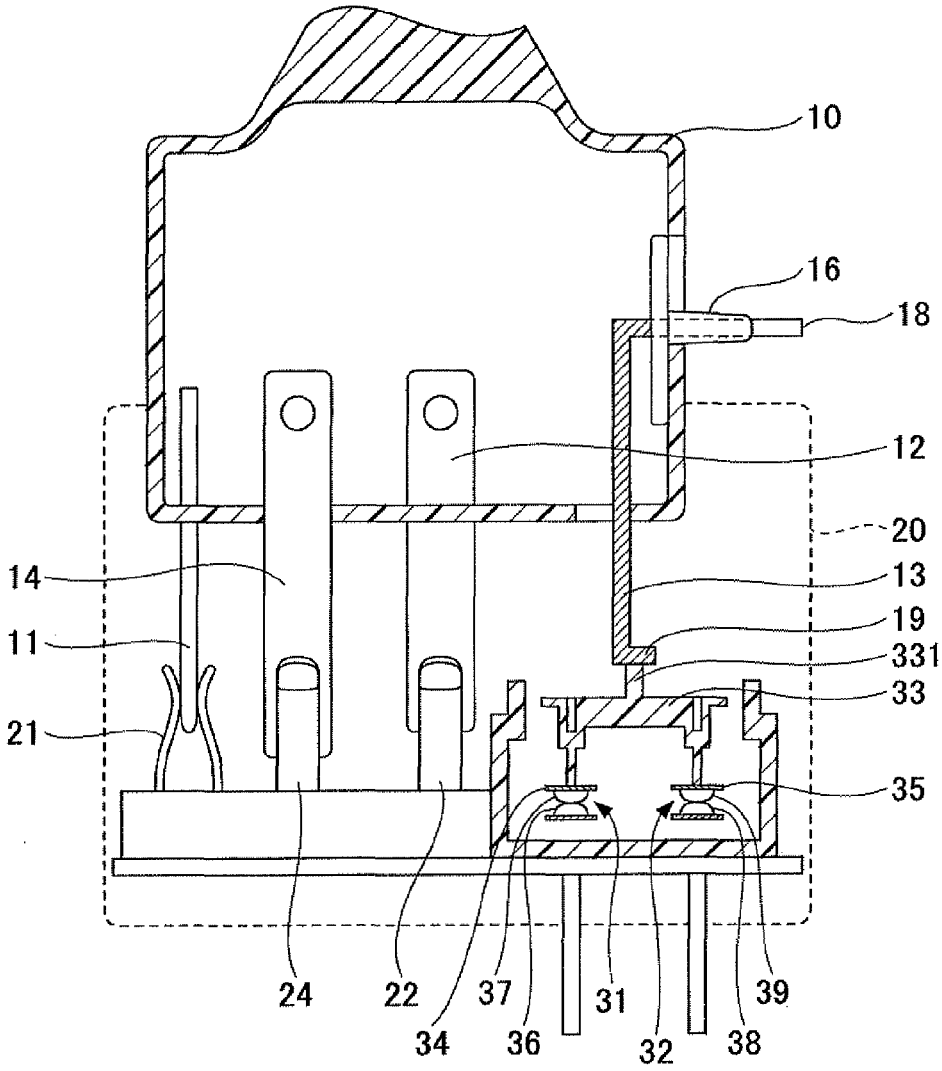

FIG. 7C and FIG. 8C illustrate the control plug terminal 13 in the extended state with the male connector 10 being inserted in the female connector 20.

Moving the slide switch 16 (downward) in the insertion direction causes the control plug terminal 13 to extend, so that the end or the step part 19 of the control plug terminal 13 presses the protruding part 331 to bend and deform the leaf spring 33 of an insulator. As a result, the contacts 36 and 37 of the control switch 31 are connected, and the contacts 38 and 39 of the control switch 32 are connected.

The connecting of the contacts 36 and 37 of the control switch 31 causes electric power from the high-voltage power supply 50 illustrated in FIG. 1 to be supplied to the power jack terminal 21. Likewise, the electric power is also supplied to the power jack terminal 22. As a result, the electric power from the high-voltage power supply 50 is supplied via the power plug terminals 11 and 12 connected to the power jack terminal 21 and 22 to the information apparatus 40 such as a server illustrated in FIG. 1, which is connected to the male connector 10.

Figure 7D:
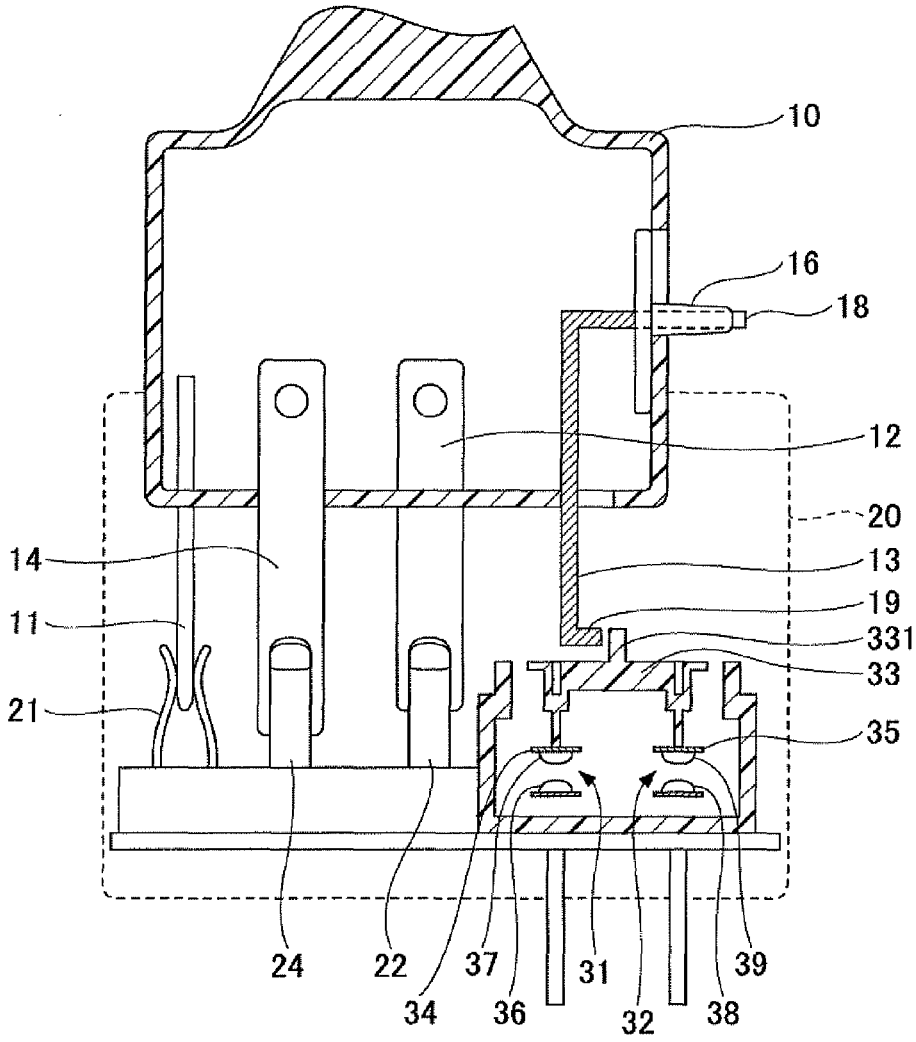

In the case of disconnecting (removing) the male connector 10 from the female connector 20, first, the return button 18 is pressed. Then, as illustrated in FIG. 7D, the control plug terminal 13 moves in a direction perpendicular to the insertion direction while remaining extended, so as to lose contact with (be detached from) the protruding part 331. As a result, the leaf spring 33 is restored so that the leaf spring part 35 in the control switch 31 is elastically restored to disconnect the contacts 36 and 37. Likewise, the contacts 38 and 39 of the control switch 32 also are disconnected.

Thus, according to this embodiment, the elastic restoring force of the leaf spring 33 allows the control plug terminal 13 to retract in a short period of time. Accordingly, it is possible to reduce or prevent generation of an arc or chattering, so that it is possible to reduce or prevent damage to the contacts of the female connector 20 and to prevent damage to an apparatus connected to the male connector 10.

Figure 9A:
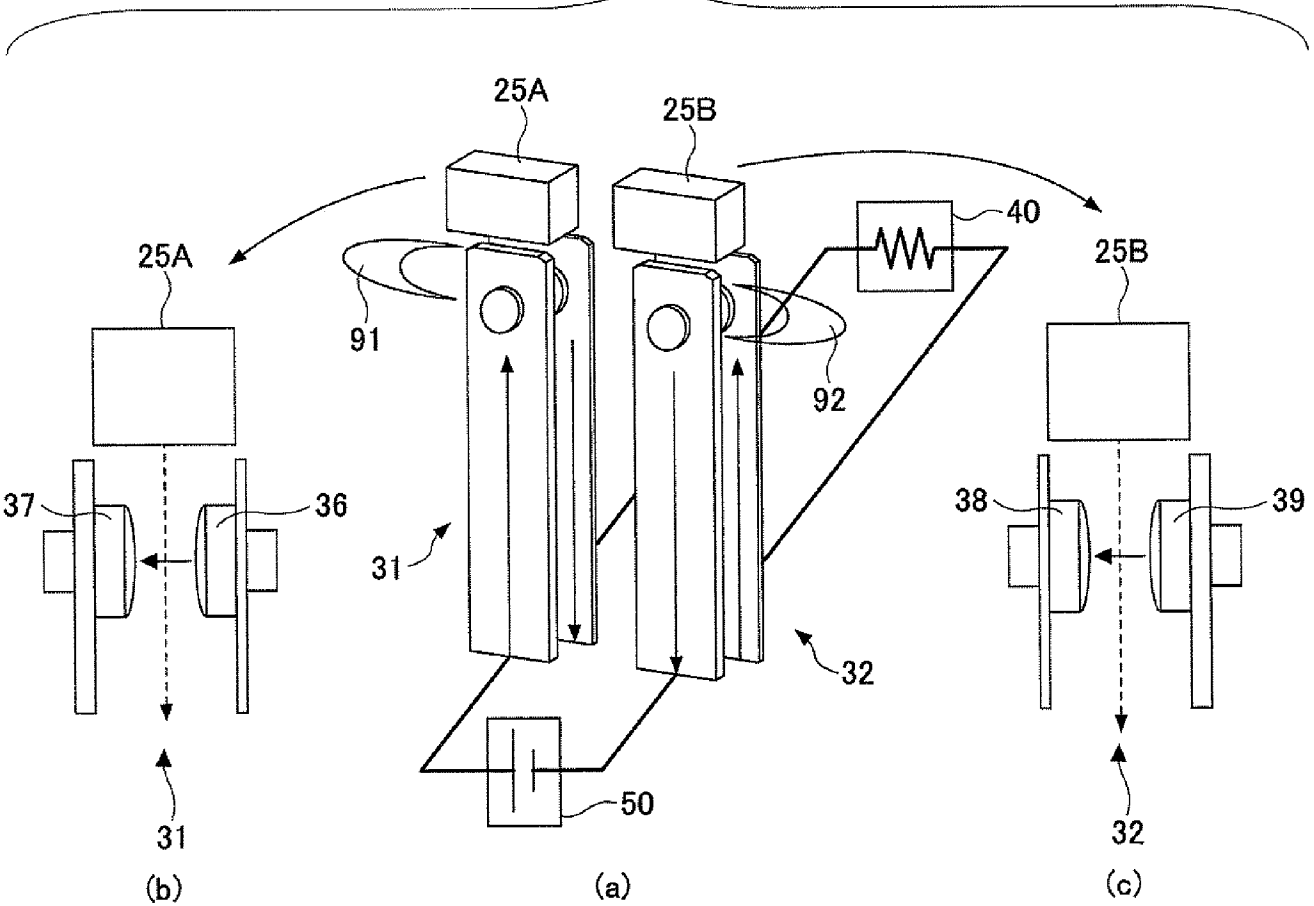
FIGS. 9A and 9B are schematic diagrams illustrating configurations of a switch part of the female connector according to the first embodiment of the present invention.
Figure 9B:
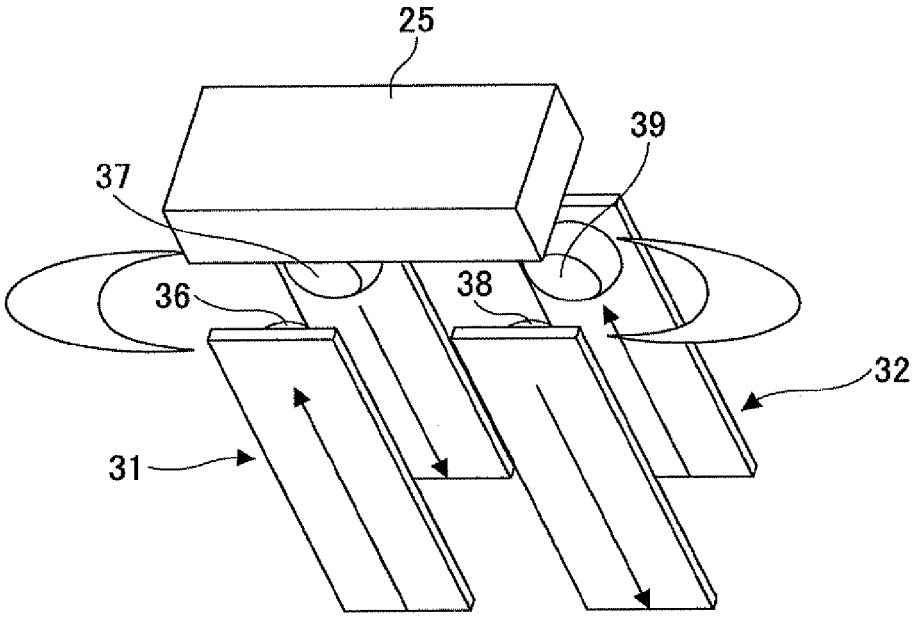

Next, a description is given, with reference to FIGS. 9A and 9B, of the contacts 36 and 37 of the control switch 31 and the contacts 38 and 39 of the control switch 32. As illustrated in FIG. 9A, a permanent magnet 25A is provided near the contacts 36 and 37 of the control switch 31, and likewise, a permanent magnet 25B is provided near the contacts 38 and 39 of the control switch 32.

As illustrated in (a) of FIG. 9A, the solid arrow in the control switch 31 indicates a direction in which current flows when the contacts 36 and 37 are connected, and the solid arrow in the control switch 32 indicates a direction in which current flows when the contacts 38 and 39 are connected. In this state, the current supplied from the power supply 50, which flows through the control switch 31 and the control switch 32, is supplied to the information apparatus 40 such as a server. Here, retracting the control plug terminal 13 causes the contacts 36 and 37 of the control switch 31 and the contacts 38 and 39 of the control switch 32 to be separated (detached) to stop the current flow. At this instant, an arc (arc current) may be generated between the contacts 36 and 37 and between the contacts 38 and 39.

According to this embodiment, the permanent magnet 25A is provided near the contact 36 and the contact 37, so that magnetic flux is generated by the permanent magnet 25A as indicated by a broken arrow as illustrated in (b) of FIG. 9A. As a result, a Lorentz force acts on the arc based on Fleming's left-hand rule, so that the arc is deflected and blown off as indicated by reference numeral 91 in (a) of FIG. 9A. Further, the permanent magnet 25B is provided near the contact 38 and the contact 39, so that magnetic flux is generated by the permanent magnet 25B as indicated by a broken arrow as illustrated in (c) of FIG. 9A. As a result, a Lorentz force acts on the arc based on Fleming's left-hand rule, so that the arc is deflected and blown off as indicated by reference numeral 92 in (a) of FIG. 9A. Thereby, the supply of electric power is immediately interrupted. As a result, it is possible to achieve a higher level of safety. The above description is given of the case of the two permanent magnets 25A and 25B. However, this embodiment is not limited to this, and a single permanent magnet 25 may be used in place of the two permanent magnets 25A and 25B as illustrated in FIG. 9B.

As described above, according to the connector unit of this embodiment, by extending the control plug terminal 13 with the power plug terminals 11 and 12 of the male connector 10 being fit into the power jack terminals 21 and 22, respectively, of the female connector 20, current is caused to flow via the control switches 31 and 32 provided at the control jack terminal 23, so that electric power is supplied to the information apparatus 40 via the power jack terminals 21 and 22 of the female connector 20 and the power plug terminals 11 and 12 of the male connector 10.

Thus, according to this embodiment, electric power is supplied through the power jack terminals 21 and 22 only when the control plug terminal 13 is in the extended state. This is for preventing a high voltage of 400 VDC from being applied to the power jack terminals 21 and 22 when the male connector 10 is not connected to the female connector 20. That is, if a high voltage of 400 VDC is applied to the power jack terminals 21 and 22 of the female connector 20 without the male connector 10 joined to the female connector 20, inadvertently touching the power jack terminals 21 and 22 directly or through a driver, a metal piece, or a half-broken lead wire may put a human body in danger. In order to avoid such a situation, electric power is supplied through the power jack terminals 21 and 22 only when the control plug terminal 13 is in the extended state.

Next, a description is given of a configuration of an electric power supply system using the connector unit of this embodiment.

Figure 10:
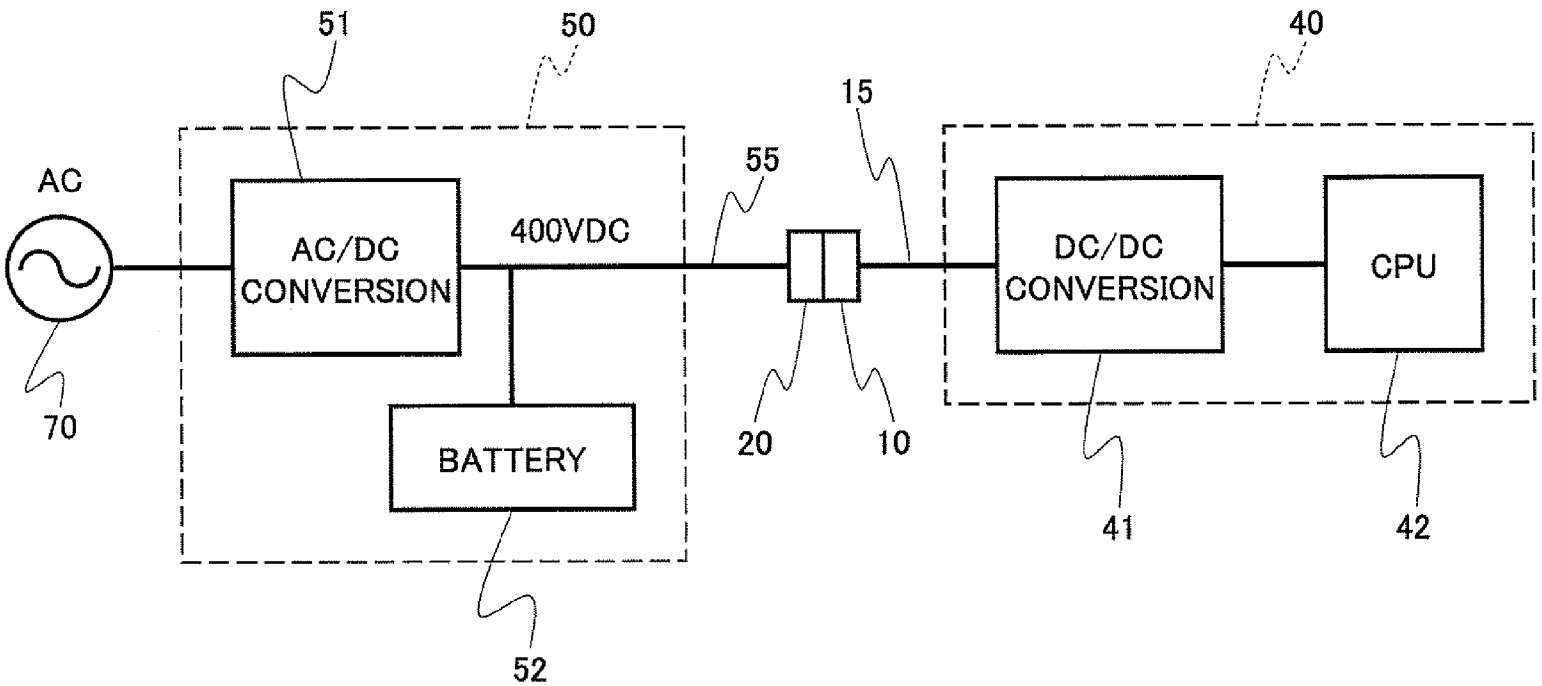
FIG. 10 is a block diagram illustrating a configuration of an electric power supply system using the connector unit according to the first embodiment of the present invention.

FIG. 10 is a block diagram illustrating a configuration of an electric power supply system using the connector unit of this embodiment.

According to this electric power supply system, the electric power of 100 VAC or 200 VAC supplied from a commercial power supply 70 is input to the high-voltage power supply 50, where 100 VAC or 200 VAC is converted into 400 VDC by an AC/DC converter 51 of the high-voltage power supply 50. It is possible to store DC electric power as energy using a battery. Accordingly, a backup battery 52 is provided in the high-voltage power supply 50. This makes it possible to readily respond to situations such as a power failure. The female connector 20 according to this embodiment is connected to the high-voltage power supply 50 via a power supply cable 55, so that the electric power of 400 VDC from the high-voltage power supply 50 is supplied through the female connector 20.

On the other hand, the male connector 10 according to this embodiment is connected to the information apparatus 40 such as a server via the power supply cable 15. The female connector 20 and the male connector 10 are electrically connected so that the electric power from the high-voltage power supply 50 is supplied to the information apparatus 40 such as a server.

Further, the information apparatus 40 such as a server includes a DC/DC converter 41 that converts 400 VDC into low-voltage DC output with which electronic components of the information apparatus 40, such as a CPU 42, can operate.

This electric power supply system is advantageous, for example, in that power loss is small because there is only one DC conversion of the AC power from the commercial power supply 70; it is not necessary to pay much attention to the thickness of a lead wire or the like in the case of the high-voltage direct current of 400 VDC; and it is easy to respond to the suspension of the power supply of the commercial power supply 70 due to a power failure because the supplied power is DC and can be stored as energy in the battery 52.

Figure 11:
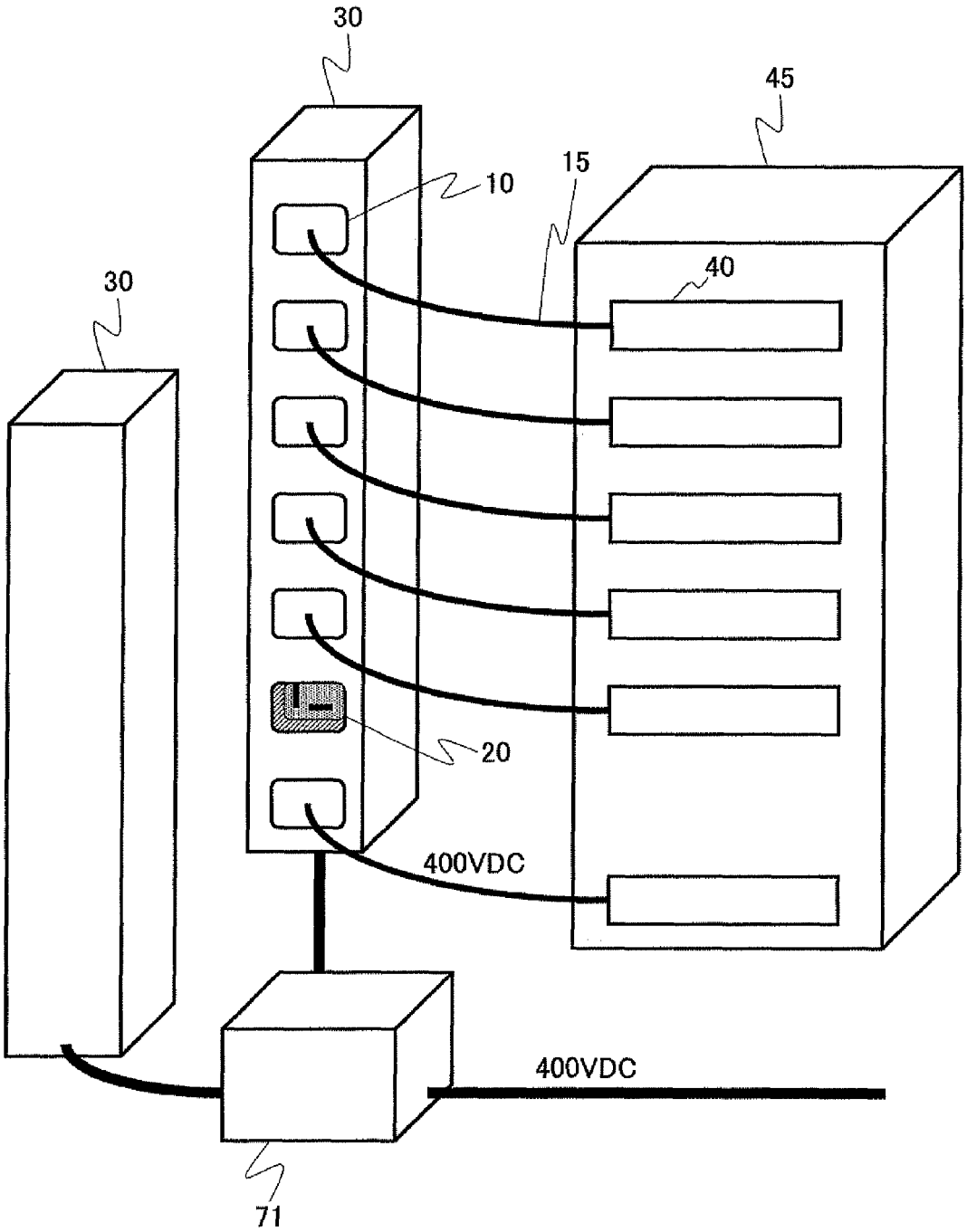
FIG. 11 is a perspective view of a power distribution unit using the connector unit according to the first embodiment of the present invention.

Next, a description is given, with reference to FIG. 11, of a power distribution unit (PDU) using the connector unit according to this embodiment.

The electric power of 400 VDC supplied from the high-voltage power supply 50 illustrated in FIG. 10 is input to a distribution board 71, which distributes the input electric power to multiple PDUs 30. Each PDU 30 includes multiple female connectors 20 according to this embodiment, and can supply the 400 VDC electric power through each of the female connectors 20. On the other hand, a server rack 45 houses multiple information apparatuses 40 such as servers, which are connected to respective male connectors 10 for receiving a supply of electric power via power supply cables 15. The male connectors 10 are electrically connected to the corresponding female connectors 20 provided in the PDUs 30 so that the information apparatuses 40 are supplied with the 400 VDC electric power.

The above description is given of the case of 400 VDC. However, the connector unit, the male connector 10, and the female connector 20 according to this embodiment are applicable to any case of direct current (DC). Unlike in the case of AC, no frequencies are safe for human bodies in the case of DC.

Further, in light of influence on human bodies, voltages lower than or equal to 48 V are usually used as direct-current voltage. This is because usually, human bodies are almost immune to electric shock if the voltage is lower than or equal to 48 V. On the other hand, the influence on human bodies is significant if the voltage exceeds 48 V, and voltages higher than or equal to 200 V are particularly dangerous.

The connector unit, the male connector 10, and the female connector 20 according to this embodiment have increased safety, and produce remarkable effects particularly in the case of voltages exceeding 48 V, for example, voltages higher than or equal to 200 V. That is, the connector unit, the male connector 10, and the female connector 20 according to this embodiment have their safety increased with a configuration different from the conventional one so as to have increased safety with respect to voltages exceeding 48 V, for example, voltages higher than or equal to 200 V, as well. As a result, the connector unit, the male connector 10, and the female connector 20 according to this embodiment produce remarkable effects particularly in the case of voltages exceeding 48 V, for example, voltages higher than or equal to 200 V.

[b] Second Embodiment

Next, a description is given of a connector unit, a male connector, and a female connector according to a second embodiment of the present invention.

Figure 12:
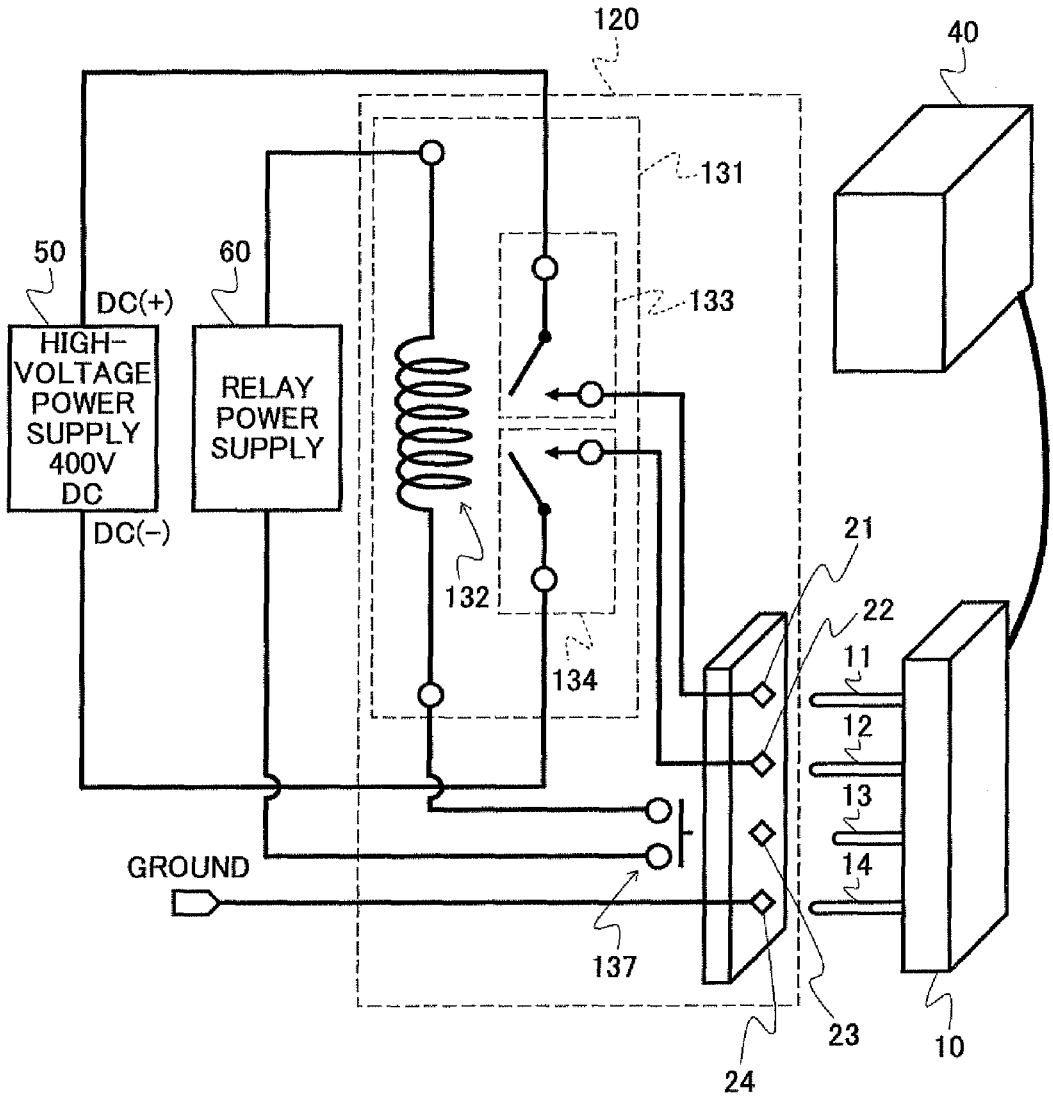
FIG. 12 is a diagram illustrating a configuration of a connector unit according to a second embodiment of the present invention.

FIG. 12 is a schematic diagram illustrating a configuration of a connector unit, a configuration of a male connector, and a configuration of a female connector according to this embodiment. In FIG. 12, the same elements as those illustrated in FIG. 1 through FIG. 11 are referred to by the same reference numerals, and a description thereof is omitted.

Referring to FIG. 12, a connector unit according to this embodiment includes the male connector 10 and a female connector 120. The female connector 120 is connected to the high-voltage power supply 50 for supplying electric power. The female connector 120 includes the power jack terminals 21 and 22 corresponding to the power plug terminals 11 and 12, the control jack terminal 23 corresponding to the control plug terminal 13, and the ground jack terminal 24 corresponding to the ground plug terminal 14.

The female connector 120 further includes a relay 131 including a coil 132 and two pairs of relay contacts (relay contact pairs) 133 and 134. By causing electric current to flow through the coil 132, each of the relay contact pairs 133 and 134 is closed to have its contacts connected. Without electric current flowing through the coil 132, each of the relay contact pairs 133 and 134 is open with its contacts separated (disconnected).

One of the contacts of the relay contact pair 133 is connected to the positive output of the high-voltage power supply 50, and the other one of the contacts of the relay contact pair 133 is connected to the power jack terminal 21. One of the contacts of the relay contact pair 134 is connected to the negative output of the high-voltage power supply 50, and the other one of the contacts of the relay contact pair 134 is connected to the power jack terminal 22.

A relay power supply 60 for driving the relay 131 is connected to the female connector 120. That is, one of the terminals of the coil 132 of the relay 131 is connected to one of the terminals of the relay power supply 60, and the other one of the terminals of the coil 132 and the other one of the terminals of the relay power supply 60 are connected to a control switch 137.

Extending the control plug terminal 13 of the male connector 10 in the insertion direction with the male connector 10 and the female connector 120 being fit to each other causes the control switch 137 to establish an electrical connection.

The control switch 137 thus establishes an electrical connection, so that the electric current from the relay power supply 60 flows through the coil 132 to close the relay contact pairs 133 and 134 in the relay 131. As a result, the power jack terminals 21 and 22 of the female connector 120 are supplied with electric power, which is further supplied to the information apparatus 40 such as a server via the power plug terminals 11 and 12 of the male connector 10.

According to the connector unit of this embodiment, the relay contact pairs 133 and 134 of the relay 131 are connected to the power jack terminals 21 and 22, respectively. In the case of high-voltage DC electric power of a voltage exceeding 48 V, for example, a voltage higher than or equal to 200 V, contacting electricity is extremely dangerous to human bodies. Therefore, the relay contact pairs 133 and 134 are connected to the power jack terminals 21 and 22, respectively, to control electric power supply to the power jack terminals 21 and 22, thereby further increasing safety.

According to this embodiment, the relay 131 is provided inside the body of the female connector 120. Alternatively, the relay 131 may also be provided external to the female connector 120.

Figure 13A:
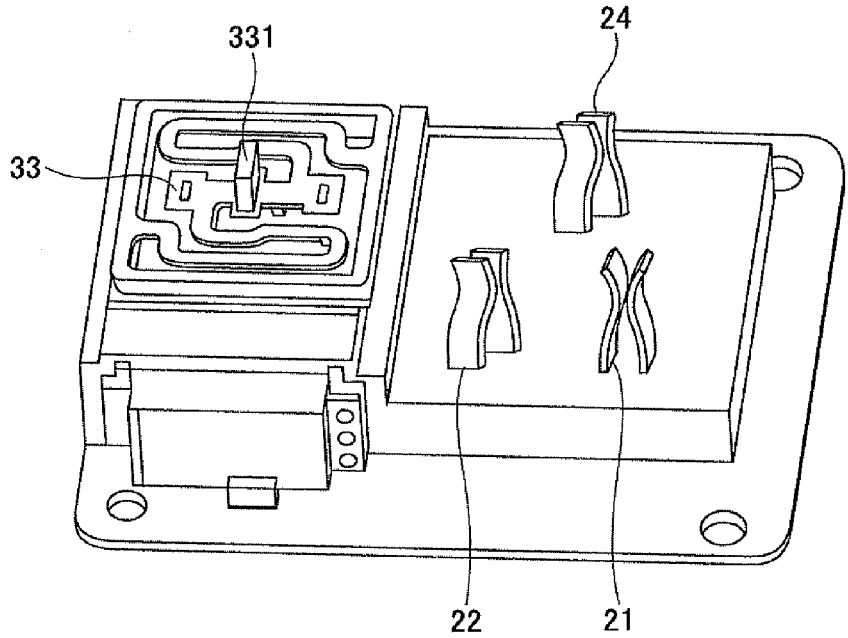
FIGS. 13A through 13C are diagrams illustrating an internal structure of a female connector according to the second embodiment of the present invention.
Figure 13B:
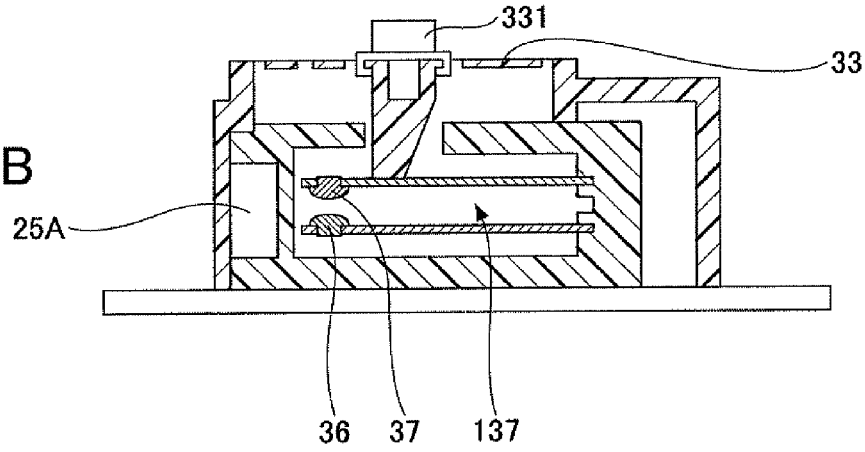
Figure 13C:
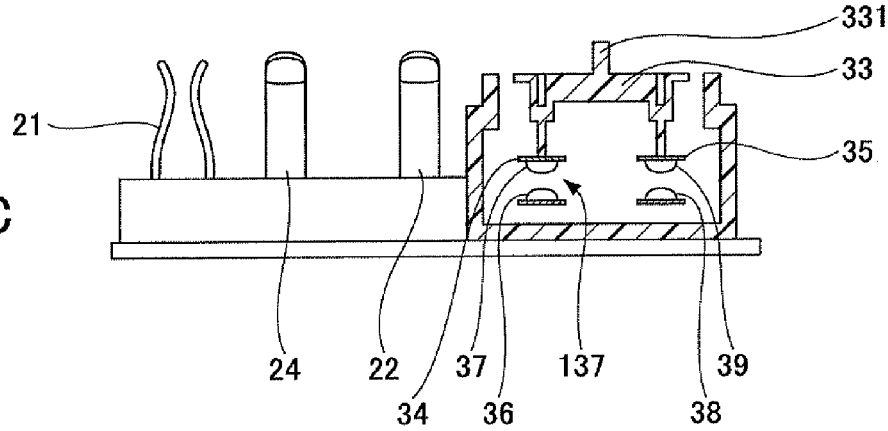

FIGS. 13A through 13C are diagrams illustrating an internal structure of the female connector 120 according to this embodiment.

In FIGS. 13A through 13C, the same elements as those illustrated in FIG. 1 through FIG. 12 are referred to by the same reference numerals, and a description thereof is omitted.

According to this embodiment, the female connector 120 includes the power jack terminals 21 and 22 and the ground jack terminal 24. A switch like a leaf spring is provided as the control switch 137 in a part serving as the control jack terminal 23 corresponding to the control plug terminal 13. The control switch 137 is connected to the leaf spring 33 of an insulator. The control switch 137 includes two switches: one configured to have the contacts 36 and 37 connected and the other configured to have the contacts 38 and 39 connected. Further, in order to prevent arcing, the permanent magnet 25A is provided near the contacts 36 and 37 and the permanent magnet 25B is provided near the contacts 38 and 39. The contact 37 and the contact 39 are electrically connected. The contact 36 is connected to the relay power supply 60 illustrated in FIG. 12, and the contact 38 is connected to the coil 132 of the relay 131 illustrated in FIG. 12.

When the control plug terminal 13 of the male connector 10 is in the extended state, the leaf spring 33 bends to simultaneously connect the contacts 36 and 37 and the contacts 38 and 39 of the respective leaf spring switches. As a result, the contact 36 and the contact 38 are electrically connected, so that electric power is supplied form the relay power supply 60. Consequently, electric current flows through the coil 132 of the relay 131 to close the relay contact pairs 133 and 134, so that electric power is supplied from the high-voltage power supply 50 through the power jack terminals 21 and 22.

The connector unit according to this embodiment may be applied to the electric power supply system illustrated in the first embodiment (FIG. 10).

[c] Third Embodiment

Next, a description is given of a connector unit, a male connector, and a female connector according to a third embodiment of the present invention.

Figure 14:
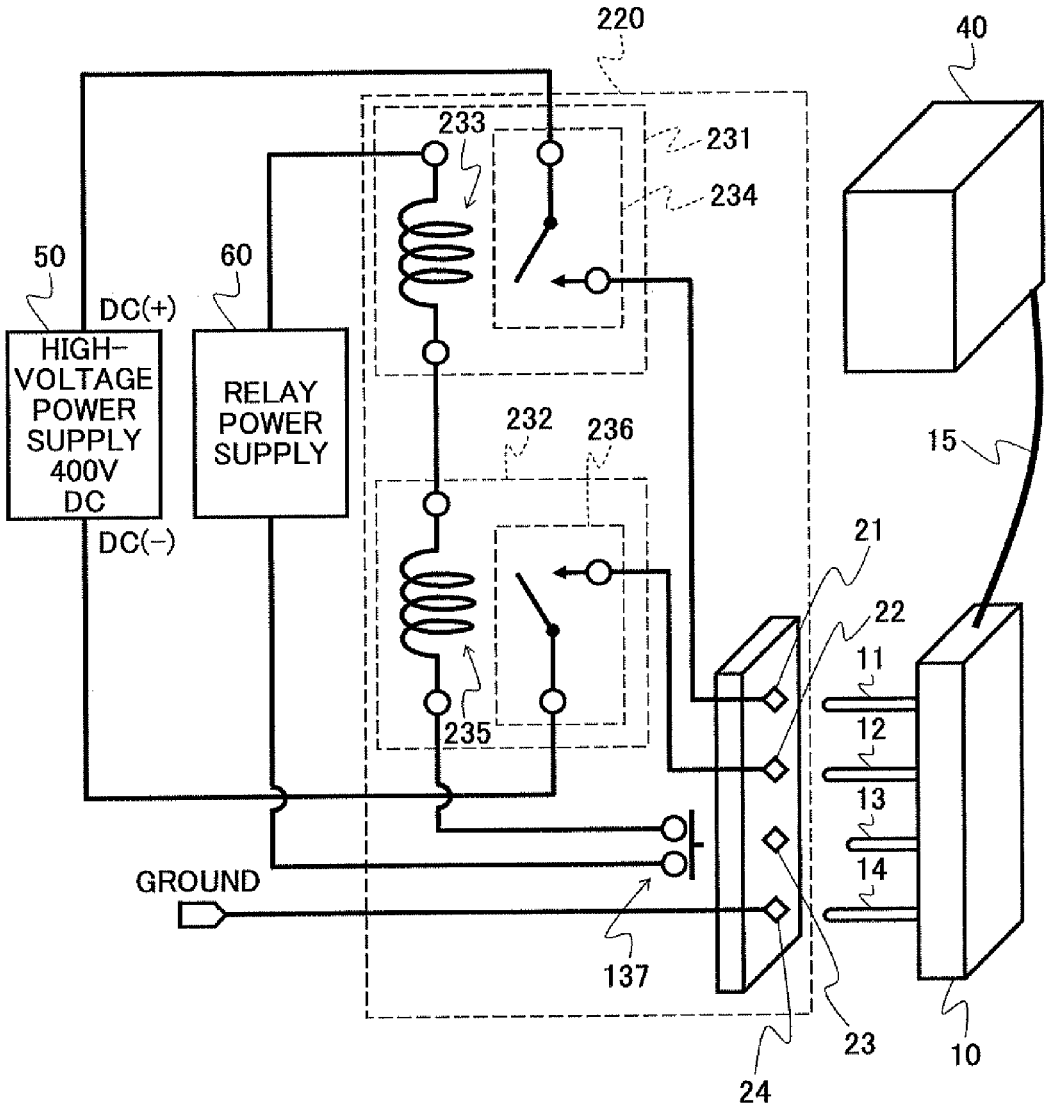
FIG. 14 is a diagram illustrating a configuration of a connector unit according to a third embodiment of the present invention.

FIG. 14 is a schematic diagram illustrating a configuration of a connector unit, a configuration of a male connector, and a configuration of a female connector according to this embodiment.

In FIG. 14, the same elements as those illustrated in FIG. 1 through FIG. 12 are referred to by the same reference numerals, and a description thereof is omitted.

Referring to FIG. 14, a connector unit according to this embodiment includes the male connector 10 and a female connector 220. The female connector 220 may have the same internal structure as illustrated in FIGS. 13A through 13C. Accordingly, a graphical representation of the internal structure of the female connector 220 is omitted.

The female connector 220 is connected to the high-voltage power supply 50 for supplying electric power. The female connector 220 includes the power jack terminals 21 and 22 corresponding to the power plug terminals 11 and 12, the control jack terminal 23 corresponding to the control plug terminal 13, and the ground jack terminal 24 corresponding to the ground plug terminal 14.

The female connector 220 includes two relays 231 and 232. The relay 231 includes a coil 233 and a relay contact pair 234. The relay contact pair 234 is closed to have its contacts connected by causing electric current to flow through the coil 233. Without electric current flowing through the coil 233, this relay contact pair 234 is open with its contacts separated (disconnected). The relay 232 includes a coil 235 and a relay contact pair 236. The relay contact pair 236 is closed to have its contacts connected by causing electric current to flow through the coil 235. Without electric current flowing through the coil 235, this relay contact pair 236 is open with its contacts separated (disconnected).

One of the contacts of the relay contact pair 234 is connected to the positive output of the high-voltage power supply 50, and the other one of the contacts of the relay contact pair 234 is connected to the power jack terminal 21. One of the contacts of the relay contact pair 236 is connected to the negative output of the high-voltage power supply 50, and the other one of the contacts of the relay contact pair 236 is connected to the power jack terminal 22.

The female connector 220 is connected to the relay power supply 60 for driving the relays 231 and 232. One of the terminals of the coil 233 of the relay 231 is connected to one of the terminals of the coil 235 of the relay 232, so that the coil 233 of the relay 231 and the coil 235 of the relay 232 are connected in series. The other one of the terminals of the coil 233 is connected to one of the terminals of the relay power supply 60, and the other one of the terminals of the coil 235 and the other one of the terminals of the relay power supply 60 are connected to the control switch 137.

Extending the control plug terminal 13 of the male connector 10 in the insertion direction, with the male connector 10 and the female connector 220 being fit to each other, causes the control switch 137 to connect its contacts.

The contacts of the control switch 137 are thus connected to cause electric current to flow from the relay power supply 60 to the coil 233 of the relay 231 and the coil 325 of the relay 232, so that the relay contact pairs 234 and 236 are closed. As a result, the power jack terminals 21 and 22 of the female connector 220 are supplied with electric power, which is further supplied to the information apparatus 40 such as a server via the power plug terminals 11 and 12 of the male connector 10.

According to the connector unit of this embodiment, the relay contact pair 234 of the relay 231 and the relay contact pair 236 of the relay 232 are connected to the power jack terminals 21 and 22, respectively. In the case of high-voltage DC electric power of a voltage exceeding 48 V, for example, a voltage higher than or equal to 200 V, contacting electricity is extremely dangerous to human bodies. Therefore, the relay contact pairs 234 and 236 are connected to the power jack terminals 21 and 22, respectively, to control the electric power supply through the power jack terminals 21 and 22, thereby further increasing safety.

According to this embodiment, the relays 231 and 232 are provided inside the body of the female connector 220. Alternatively, the relays 231 and 232 may be provided external to the female connector 220.

The connector unit according to this embodiment may be applied to the electric power supply system illustrated in the first embodiment (FIG. 10).

[d] Fourth Embodiment

Next, a description is given of a connector unit, a male connector, and a female connector according to a fourth embodiment of the present invention.

Figure 15:
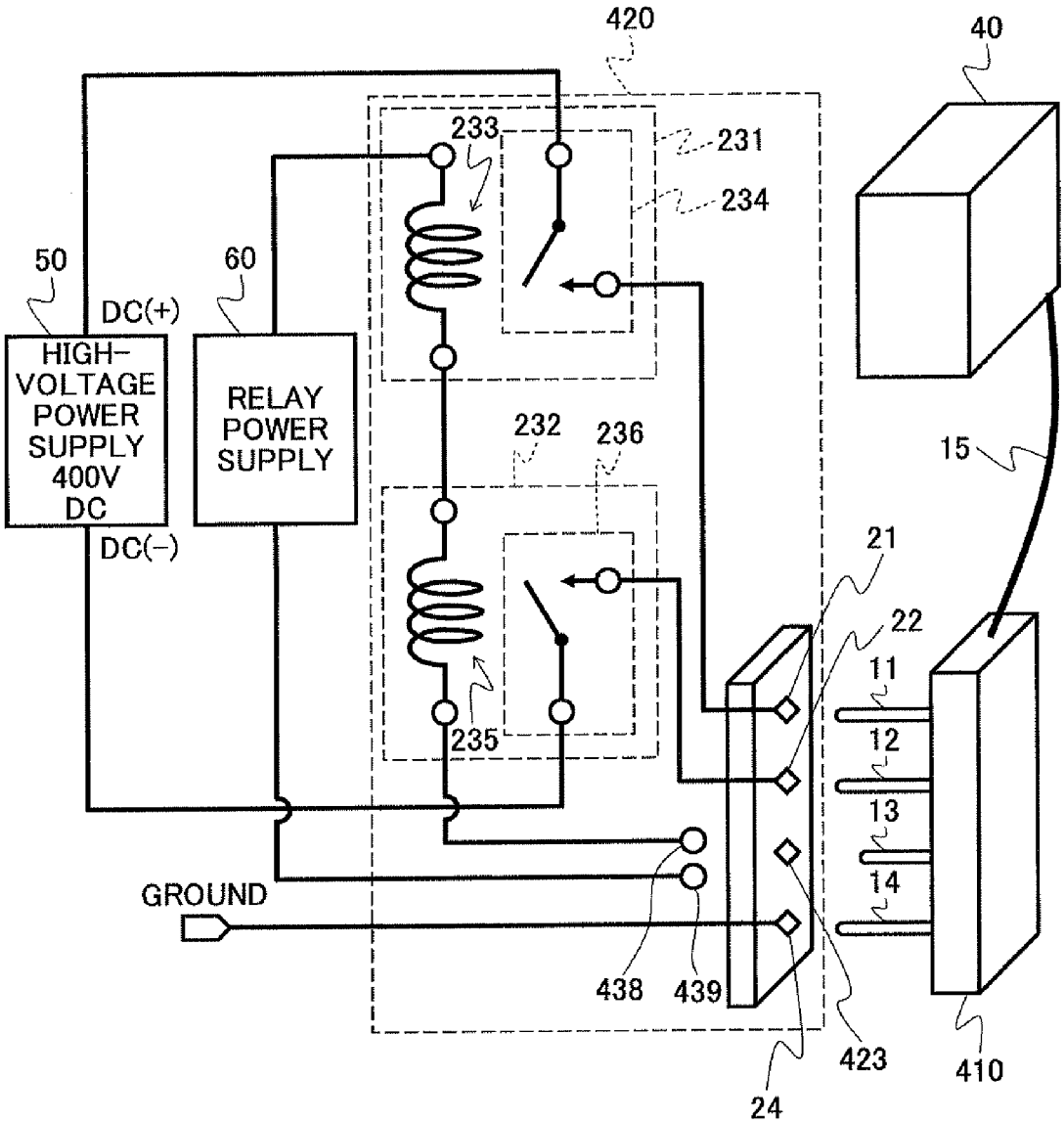
FIG. 15 is a diagram illustrating a configuration of a connector unit according to a fourth embodiment of the present invention.

FIG. 15 is a schematic diagram illustrating a configuration of a connector unit, a configuration of a male connector, and a configuration of a female connector according to this embodiment. In FIG. 15, the same elements as those illustrated in FIG. 1 through FIG. 14 are referred to by the same reference numerals.

A connector unit according to this embodiment includes a male connector 410 and a female connector 420. The male connector 410 is connected to the information apparatus 40 such as a server via the power supply cable 15. The male connector 410 includes the power plug terminals 11 and 12 for receiving a supply of electric power, the control plug terminal 13, and the ground plug terminal 14 for grounding. The control plug terminal 13 is configured to be movable back and forth relative to the insertion direction of the male connector 410.

On the other hand, the female connector 420 is connected to the high-voltage power supply 50 for supplying electric power. The female connector 420 includes the power jack terminals 21 and 22 corresponding to the power plug terminals 11 and 12, respectively, a control jack terminal 423 including a pair of control electrodes 438 and 439, and the ground jack terminal 24 corresponding to the ground plug terminal 14.

The female connector 420 further includes the relays 231 and 232. The relay 231 includes the coil 233 and the relay contact pair 234. The relay contact pair 234 is closed to have its contacts connected by causing electric current to flow through the coil 233. Without electric current flowing through the coil 233, this relay contact pair 234 is open with its contacts separated (disconnected). The relay 232 includes the coil 235 and the relay contact pair 236. The relay contact pair 236 is closed to have its contacts connected by causing electric current to flow through the coil 235. Without electric current flowing through the coil 235, this relay contact pair 236 is open with its contacts separated (disconnected).

One of the contacts of the relay contact pair 234 is connected to the positive output of the high-voltage power supply 50, and the other one of the contacts of the relay contact pair 234 is connected to the power jack terminal 21. One of the contacts of the relay contact pair 236 is connected to the negative output of the high-voltage power supply 50, and the other one of the contacts of the relay contact pair 236 is connected to the power jack terminal 22.

The female connector 420 is connected to the relay power supply 60 for driving the relays 231 and 232. One of the terminals of the coil 233 of the relay 231 is connected to one of the terminals of the coil 235 of the relay 232, so that the coil 233 of the relay 231 and the coil 235 of the relay 232 are connected in series. The other one of the terminals of the coil 233 is connected to one of the terminals of the relay power supply 60. Further, the other one of the terminals of the coil 235 is connected to the control electrode 438 (hereinafter referred to as the "electrode 438"), and the other one of the terminals of the relay power supply 60 is connected to the control electrode 439 (hereinafter referred to as the "electrode 439").

The electrode 438 and the electrode 439 are electrically connected by extending the control plug terminal 13 of the male connector 410 in the insertion direction with the male connector 410 and the female connector 420 being fit to each other. The control plug terminal 13 formed of a conductor is extended in the insertion direction to come into contact with each of the electrodes 438 and 439, so that the electrodes 438 and 439 are electrically connected via the control plug terminal 13.

The electrodes 438 and 439 are thus electrically connected to cause electric current to flow from the relay power supply 60 to the coil 233 of the relay 231 and the coil 325 of the relay 232, so that the relay contact pairs 234 and 236 are closed. As a result, the power jack terminals 21 and 22 of the female connector 420 are supplied with electric power, which is further supplied to the information apparatus 40 such as a server via the power plug terminals 11 and 12 of the male connector 410.

According to the connector unit of this embodiment, the relay contact pair 234 of the relay 231 and the relay contact pair 236 of the relay 232 are connected to the power jack terminals 21 and 22, respectively. In the case of high-voltage DC electric power of a voltage exceeding 48 V, for example, a voltage higher than or equal to 200 V, contacting electricity is extremely dangerous to human bodies. Therefore, the relay contact pairs 234 and 236 are connected to the power jack terminals 21 and 22, respectively, to control the electric power supply through the power jack terminals 21 and 22, thereby further increasing safety.

According to this embodiment, the relays 231 and 232 are provided inside the body of the female connector 420. Alternatively, the relays 231 and 232 may be provided external to the female connector 420.

Next, a description is given, with reference to FIGS. 16A through 16C and FIGS. 17A and 17B, of a structure of the connector unit of this embodiment.

Figure 16A:
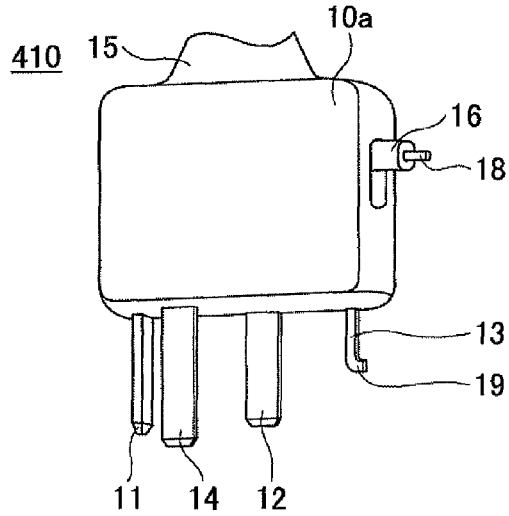
FIGS. 16A through 16C are perspective views of the exterior of a male connector according the fourth embodiment of the present invention.
Figure 16B:
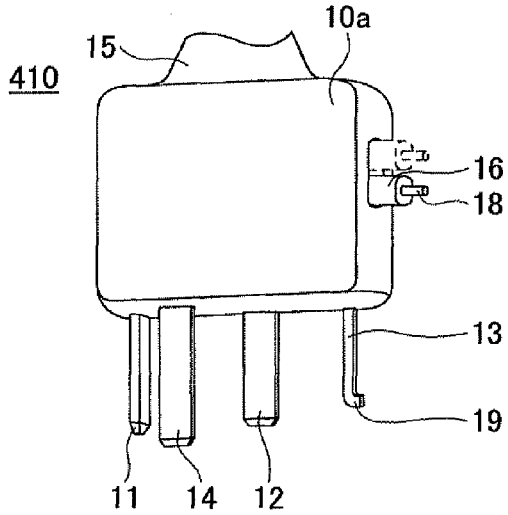
Figure 16C:
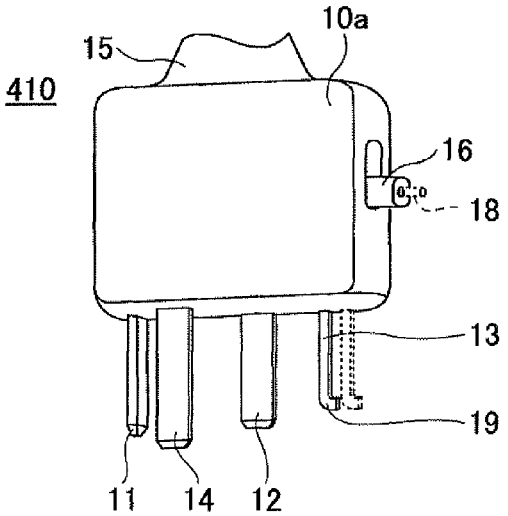

FIGS. 16A through 16C are diagrams illustrating a configuration of the male connector 410 according to this embodiment. FIG. 16A is a perspective view of the exterior of the male connector 410 with the control plug terminal 13 in a retracted state. FIG. 16B is a perspective view of the exterior of the male connector 410 with the control plug terminal 13 in an extended state. FIG. 16C is a perspective view of the exterior of the male connector 410 with the control plug terminal 13 in the extended state and the return button 18 in a pressed state.

Figure 17A:
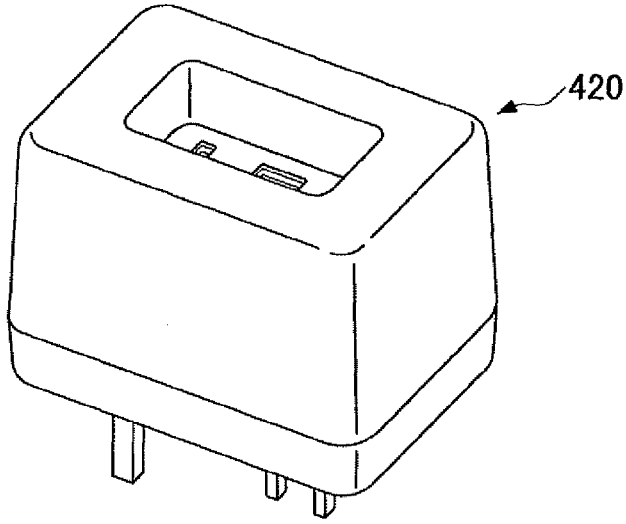
FIGS. 17A and 17B are perspective views of a female connector according to the fourth embodiment of the present invention.
Figure 17B:
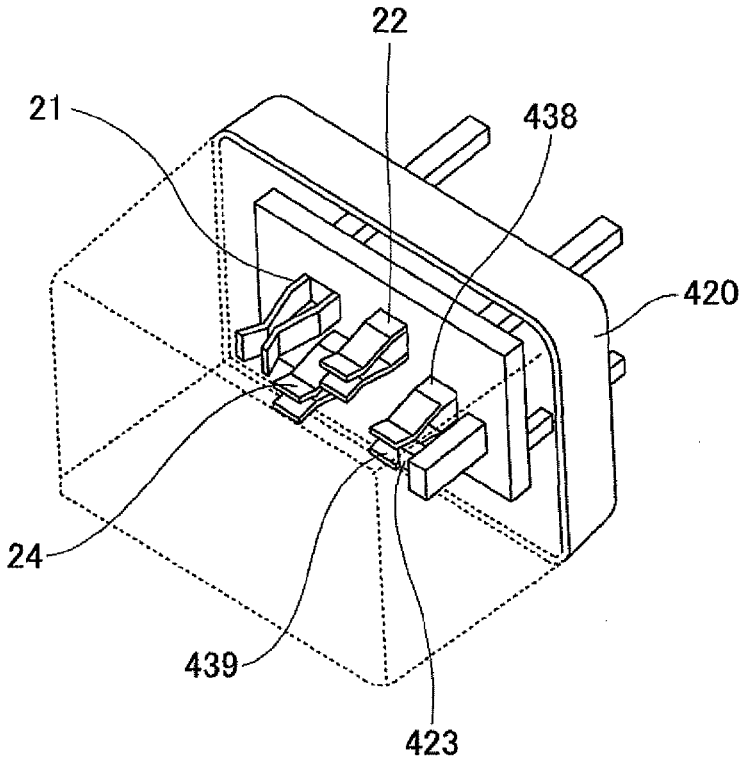

FIG. 17A is a perspective view of the exterior of the female connector 420 according to this embodiment. FIG. 17B is a partially transparent perspective view of the female connector 420 according to this embodiment.

According to this embodiment, the male connector 410 includes the two power plug terminals 11 and 12 for receiving a supply of electric power, the control plug terminal 13 formed of a conductor, the ground plug terminal 14 for grounding, the slide switch 16, and the return button 18. The male connector 410 may further include the lock terminal 17 as illustrated in FIGS. 2A through 2C. The return button 18 protrudes from the opening of the slide switch 16 in a direction perpendicular to the insertion direction of the male connector 410. The return button 18 is urged in the protruding direction by an urging part (not graphically illustrated in FIGS. 16A through 16C).

Sliding the slide switch 16 in the insertion direction of the control plug terminal 13 from the position illustrated in FIG. 16A to the position illustrated in FIG. 16B causes the control plug terminal 13 to extend. Further, pressing the return button 18 from the position illustrated in FIG. 16B to the position illustrated in FIG. 16C causes the control plug terminal 13 to move in a direction perpendicular to the insertion direction.

On the other hand, as illustrated in FIGS. 17A and 17B, the female connector 420 according to this embodiment is configured so that part of the body (housing 10*a*) of the male connector 410 is fit into the female connector 420. The female connector 420 includes the power jack terminals 21 and 22 to be connected to the power plug terminals 11 and 12, respectively; the ground jack terminal 24 to be connected to the ground plug terminal 14; and the control jack terminal 423 to be connected to the control plug terminal 13 in the extended state. The female terminal 420 may further include the recess 29 having a shape corresponding to the lock terminal 17 in a protruding state.

As illustrated in FIG. 17B, the electrodes 438 and 439 are included in the control jack terminal 423.

The electrodes 438 and 439 provided in the female connector 420 are configured to be separated, and to come into contact with the control plug terminal 13 to be electrically connected to each other via the control plug terminal 13 so as to allow electric current to flow when the control plug terminal 13 is in the extended state.

Next, a description is given, with reference to FIGS. 18A through 18E and FIGS. 19A through 19C, of a method of connecting the male connector 410 and the female connector 420 according to this embodiment.

FIGS. 18A through 18E are schematic diagrams illustrating a method of connecting the male connector 410 and the female connector 420 in a view from the front side. FIGS. 19A through 19C are schematic diagrams illustrating the method of connecting the male connector 410 and the female connector 420 in a view from one side.

Figure 18A:
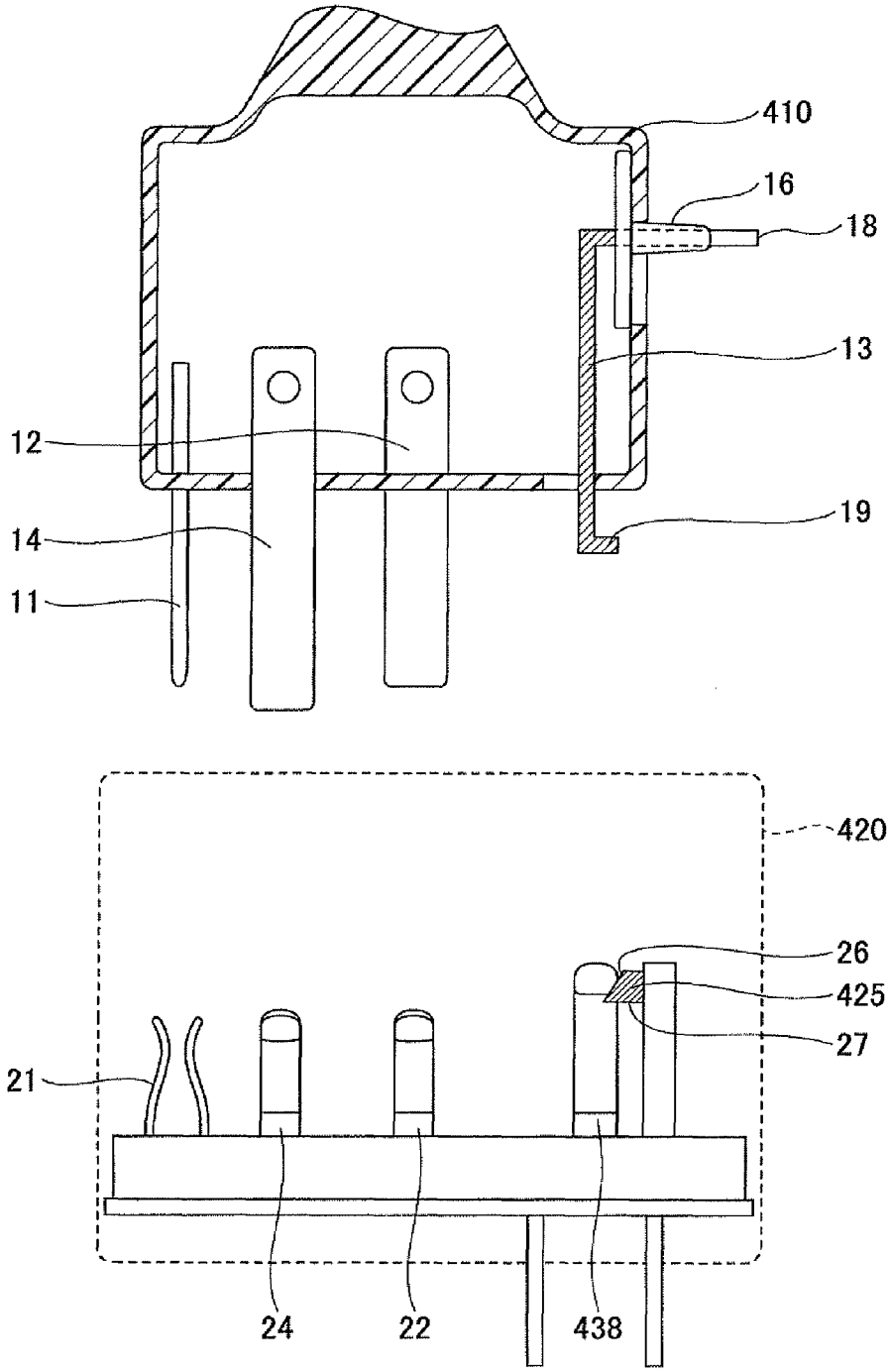
FIGS. 18A through 18E are diagrams illustrating a connecting method of the connector unit according to the fourth embodiment of the present invention.
Figure 19A:
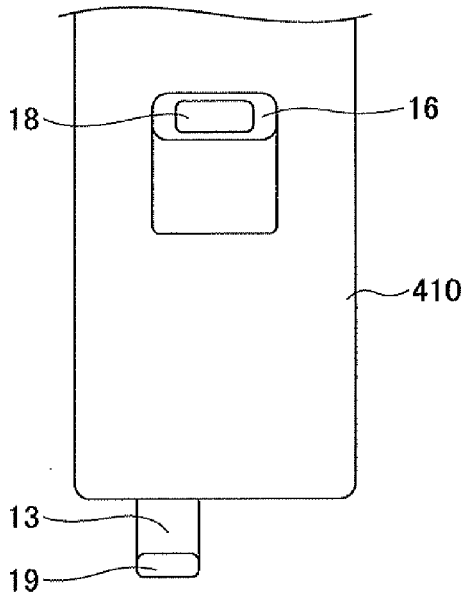
FIGS. 19A through 19C are diagrams illustrating the connecting method of the connector unit according to the fourth embodiment of the present invention.
Figure 19A:
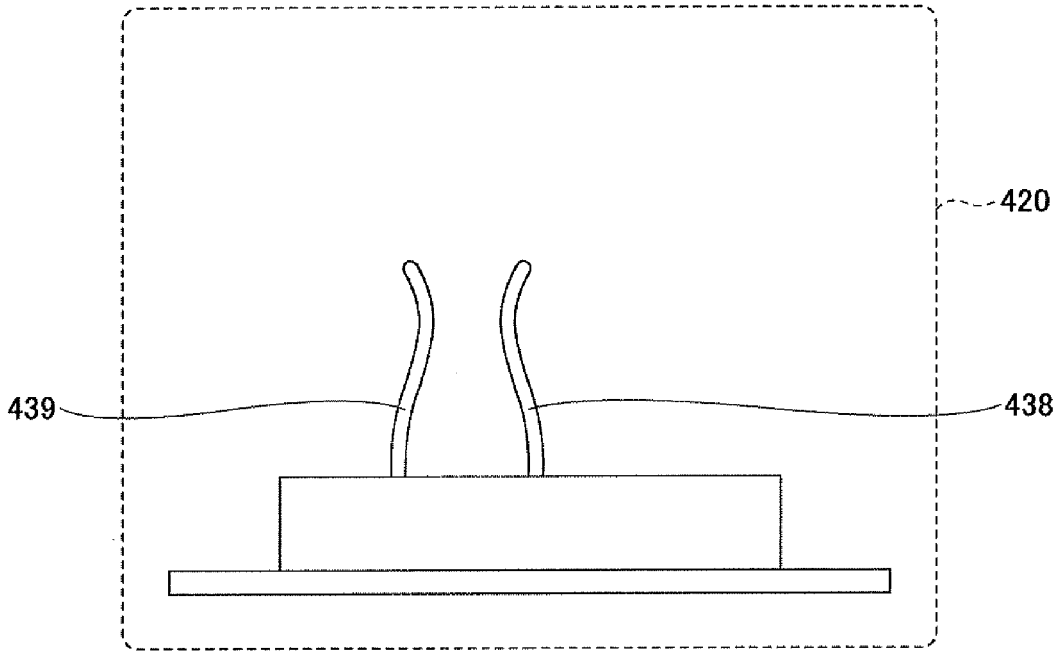
Figure 19B:
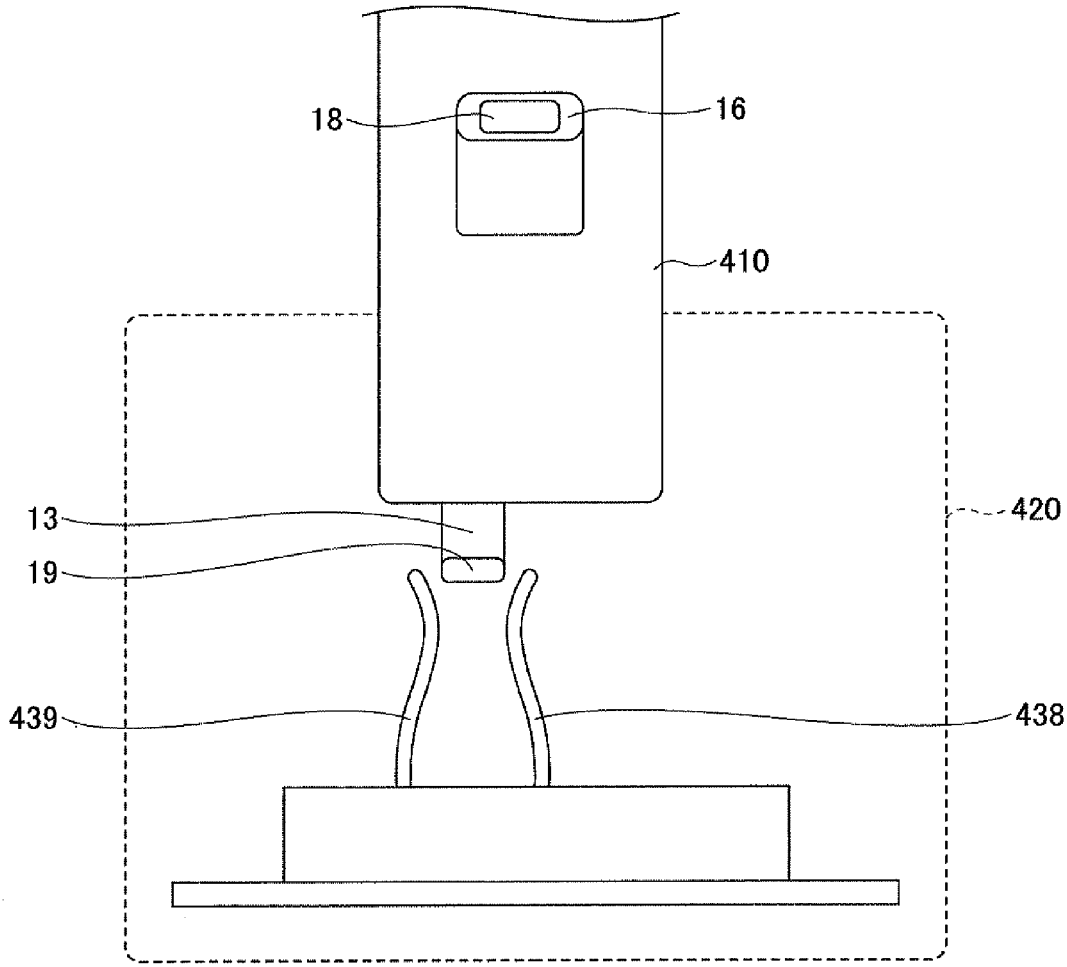
Figure 19C:
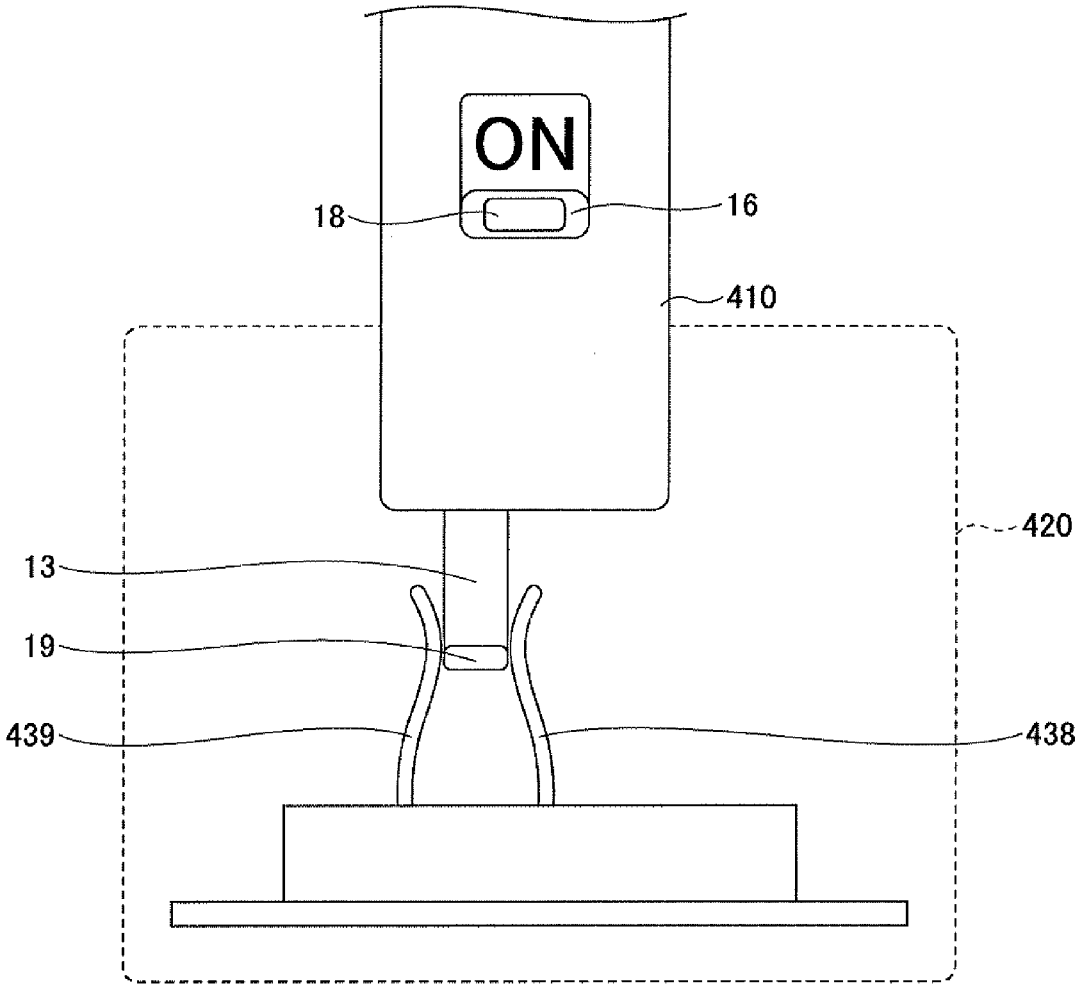

First, FIG. 18A and FIG. 19A illustrate a state before the male connector 410 and the female connector 420 are connected. In this state, the power plug terminal 11 of the male connector 410 and the power jack terminal 21 of the female connector 420 are not connected. Likewise, the power plug terminal 12 and the power jack terminal 22 are not connected, and the ground plug terminal 14 and the ground jack terminal 24 are not connected. Further, the control plug terminal 13 is retracted with the slide switch 16 for extending and retracting the control plug terminal 13 being in a state before being moved in the insertion (downward) direction.

As described above, the control plug terminal 13 includes the step part 19 at its end, which protrudes in a direction perpendicular to the insertion direction. The female connector 420 includes an engagement claw 425 that the step part 19 of the control plug terminal 13 engages and disengages from. The engagement claw 425 includes an inclined surface 26 inclined relative to the insertion direction of the control plug terminal 13 and a vertical surface 27 orthogonal to the insertion direction.

Figure 18B:
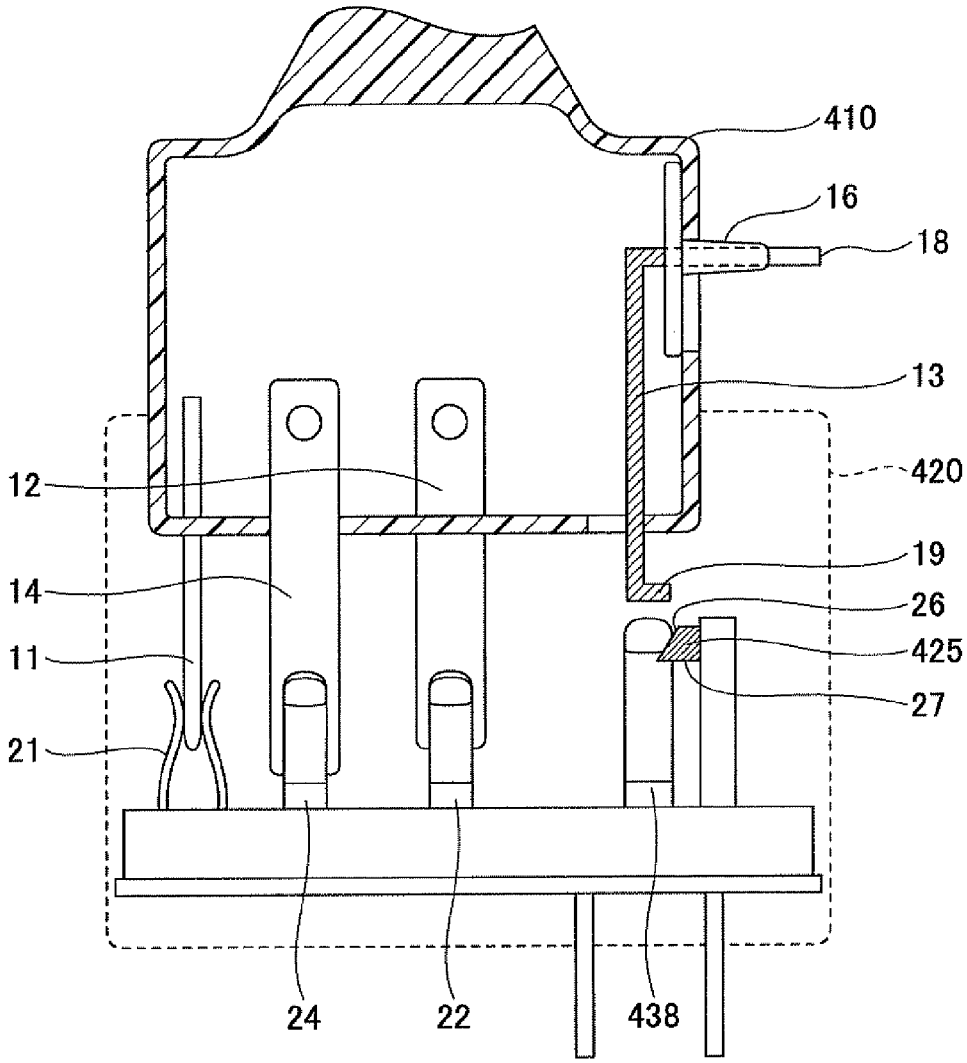

Next, FIG. 18B and FIG. 19B are diagrams illustrating a state where the male connector 410 is inserted in the female connector 420. In this state, the power plug terminal 11 of the male connector 410 is fit into the power jack terminal 21 of the female connector 420. Likewise, the power plug terminal 12 is fit into the power jack terminal 22, and the ground plug terminal 14 is fit into the ground jack terminal 24. In this state, the control plug terminal 13 remains retracted with the slide switch 16 for extending and retracting the control plug terminal 13 still in the state before being moved in the insertion (downward) direction. Accordingly, in the female connector 420, the electrodes 438 and 439 of the control jack terminal 423 are not electrically connected.

Figure 18C:
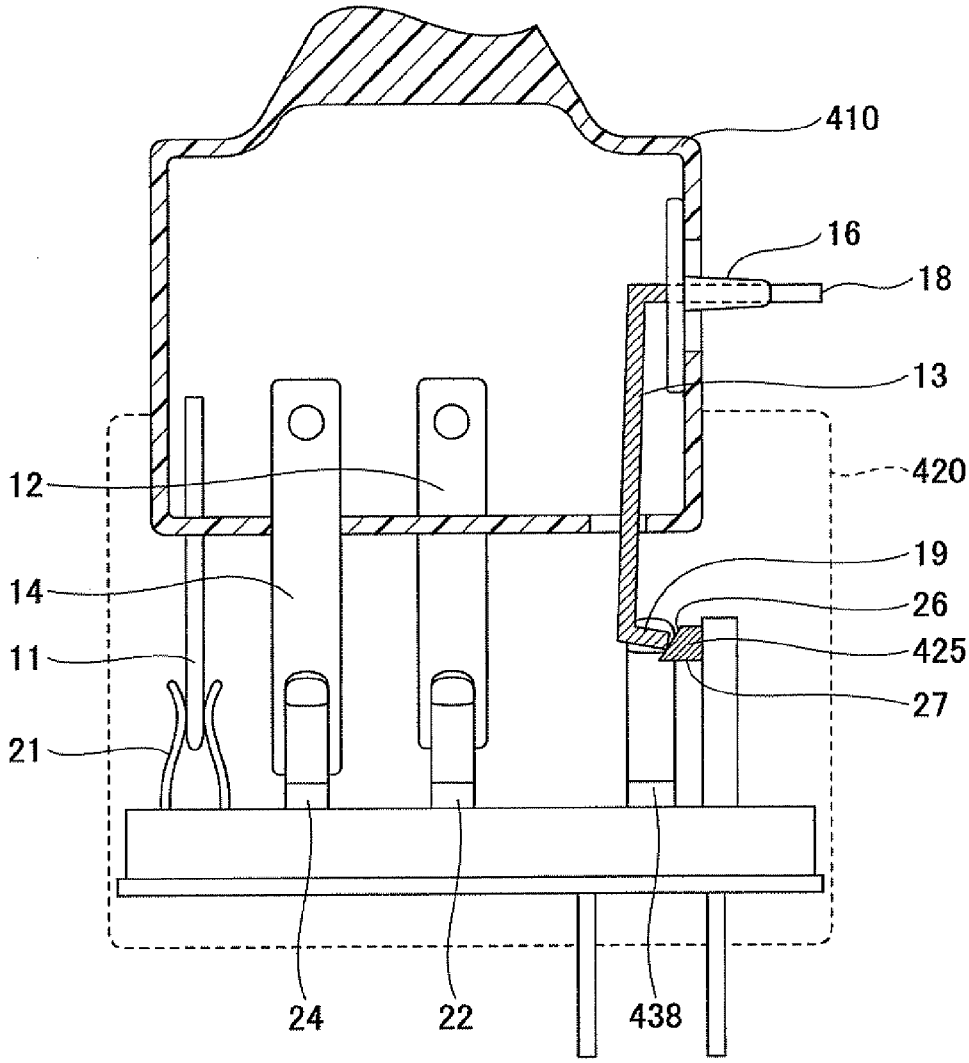

FIG. 18C is a diagram illustrating an intermediate state during a transition from the retracted state to the extended state of the control plug terminal 13 with the male connector 410 being inserted in the female connector 420.

By moving the slide switch 16 in the insertion (downward) direction, the control plug terminal 13 is caused to extend so that the step part 19 of the control plug terminal 13 comes into contact with the engagement claw 425 of the female connector 420. As a result, the step part 19 is pushed leftward in FIG. 18C by the inclined surface 26 of the engagement claw 425 so that the control plug terminal 13 bends leftward.

Figure 18D:
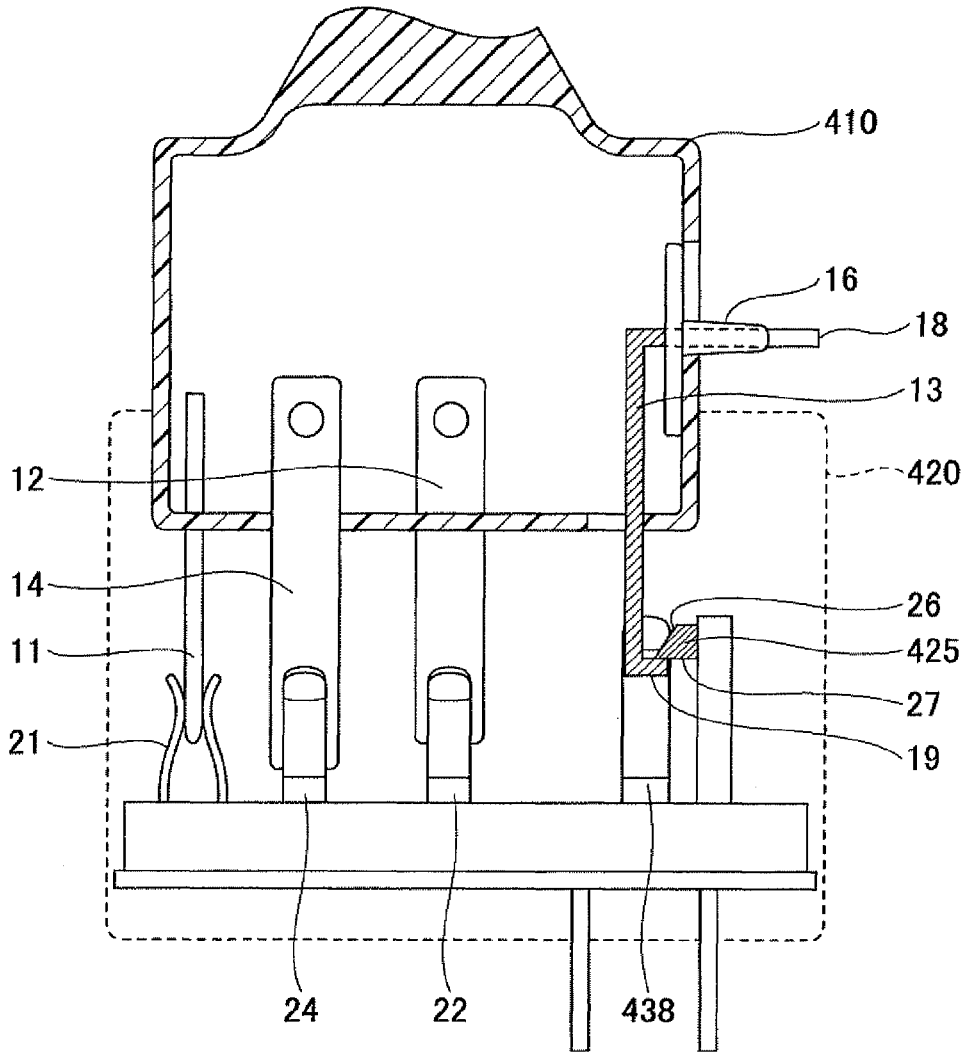

Next, FIG. 18D and FIG. 19C illustrate the control plug terminal 13 in the extended state with the male connector 410 being inserted in the female connector 420.

In this state, the electrodes 438 and 439 of the control jack terminal 423 are electrically connected via the control plug terminal 13. As a result, electric power is supplied from the relay power supply 60 illustrated in FIG. 15, and electric current flows through the coil 233 of the relay 231 and the coil 235 of the relay 232. Consequently, the relay contact pairs 234 and 236 are closed, so that electric power is supplied from the high-voltage power supply 50 through the power jack terminals 21 and 22.

Further, in this state, the control plug terminal 13 is restored so that the step part 19 of the control plug terminal 13 engages the vertical surface 27 of the engagement claw 425. This makes it possible to prevent unintended extraction of the control plug terminal 13.

Thus, according to this embodiment, it is possible to prevent unintended extraction of the control plug terminal 13 when electric power is supplied from the high-voltage power supply 50. Accordingly, it is possible to further increase safety.

Figure 18E:
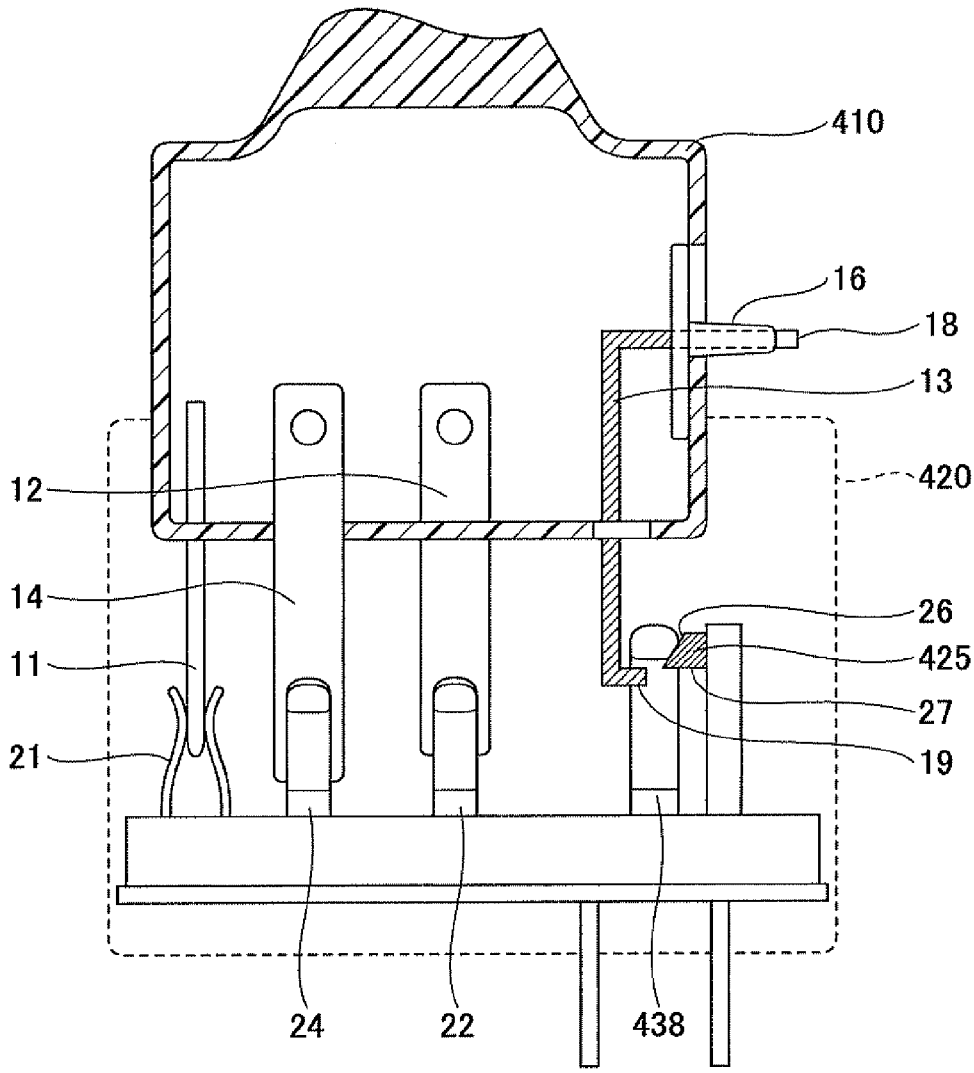

Next, FIG. 18E illustrates a state where the return button 18 is pressed in the state illustrated in FIG. 18D. In this state, the control plug terminal 13 is pushed leftward by the return button 18 to move leftward in FIG. 18C, so that the step part 19 of the control plug terminal 13 is disengaged from the engagement claw 25. As a result, it is possible to disconnect the male connector 410 and the female connector 420.

As described above, according to the connector unit of this embodiment, by extending the control plug terminal 13 with the power plug terminals 11 and 12 of the male connector 410 being fit into the power jack terminals 21 and 22, respectively, of the female connector 420, current is caused to flow via the electrodes 438 and 439 provided at the control jack terminal 423, so that electric power is supplied to the information apparatus 40 via the power jack terminals 21 and 22 of the female connector 420 and the power plug terminals 11 and 12 of the male connector 410.

Thus, according to this embodiment, electric power is supplied through the power jack terminals 21 and 22 only when the control plug terminal 13 is in the extended state. This is for preventing a high voltage of 400 VDC from being applied to the power jack terminals 21 and 22 when the male connector 410 is not connected to the female connector 420. That is, if a high voltage of 400 VDC is applied to the power jack terminals 21 and 22 of the female connector 420 without the male connector 410 joined to the female connector 420, inadvertently touching the power jack terminals 21 and 22 directly or through a driver, a metal piece, or a half-broken lead wire may put a human body in danger. In order to avoid such a situation, electric power is supplied through the power jack terminals 21 and 22 only when the control plug terminal 13 is in the extended state.

Next, a description is given of a configuration of an electric power supply system using the connector unit of this embodiment.

Figure 20:
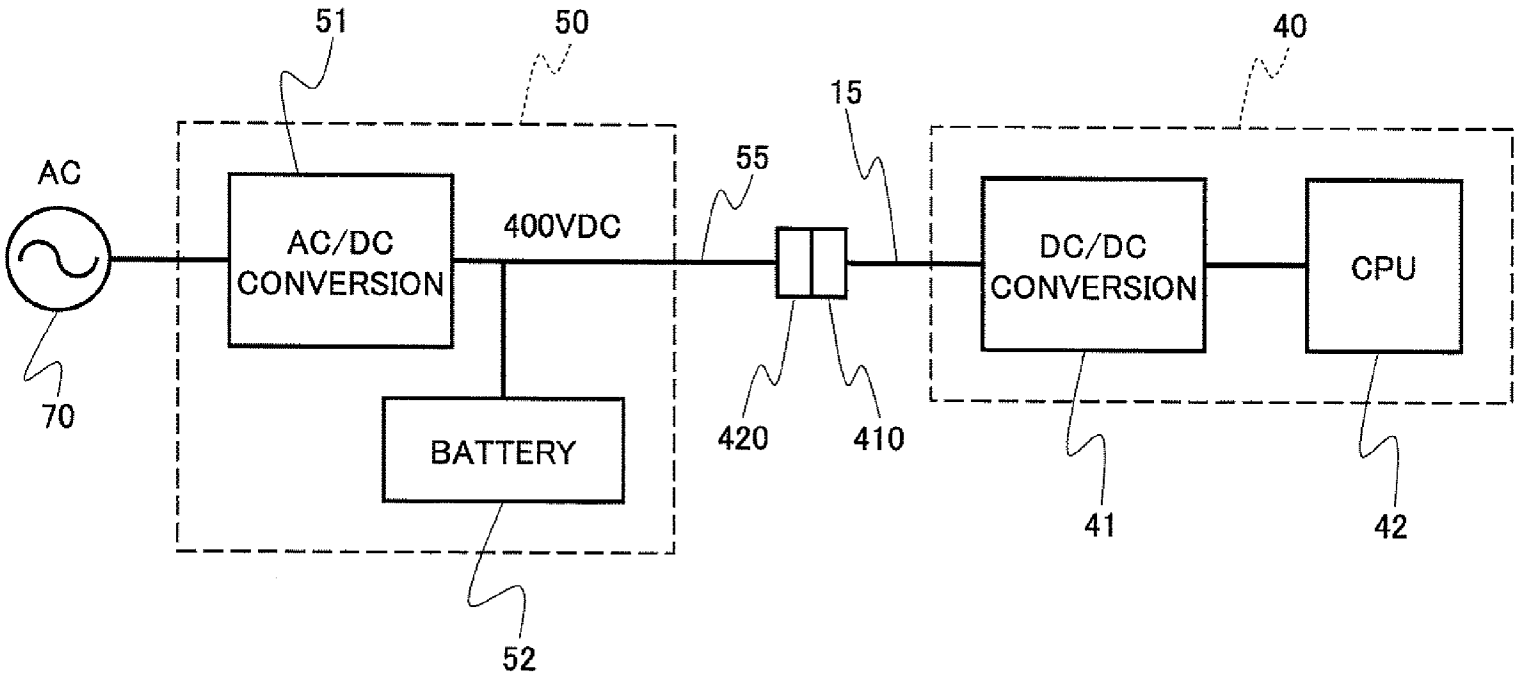
FIG. 20 is a block diagram illustrating a configuration of an electric power supply system using the connector unit according to the fourth embodiment of the present invention.

FIG. 20 is a block diagram illustrating a configuration of an electric power supply system using the connector unit of this embodiment. In FIG. 20, the same elements as those described above are referred to by the same reference numerals.

According to this electric power supply system, the electric power of 100 VAC or 200 VAC supplied from the commercial power supply 70 is input to the high-voltage power supply 50, where 100 VAC or 200 VAC is converted into 400 VDC by the AC/DC converter 51 of the high-voltage power supply 50. It is possible to store DC electric power as energy using a battery. Accordingly, the backup battery 52 is provided in the high-voltage power supply 50. This makes it possible to readily respond to situations such as a power failure. The female connector 420 according to this embodiment is connected to the high-voltage power supply 50 via the power supply cable 55, so that the electric power of 400 VDC from the high-voltage power supply 50 is supplied through the female connector 420.

On the other hand, the male connector 410 according to this embodiment is connected to the information apparatus 40 such as a server via the power supply cable 15. The female connector 420 and the male connector 410 are electrically connected so that the electric power from the high-voltage power supply 50 is supplied to the information apparatus 40 such as a server.

Further, the information apparatus 40 such as a server includes the DC/DC converter 41 that converts 400 VDC into low-voltage DC output with which electronic components of the information apparatus 40, such as the CPU 42, can operate.

This electric power supply system is advantageous, for example, in that power loss is small because there is only one DC conversion of the AC power from the commercial power supply 70; it is not necessary to pay much attention to the thickness of a lead wire or the like in the case of the high-voltage direct current of 400 VDC; and it is easy to respond to the suspension of the power supply of the commercial power supply 70 due to a power failure because the supplied power is DC and can be stored as energy in the battery 52.

Figure 21:
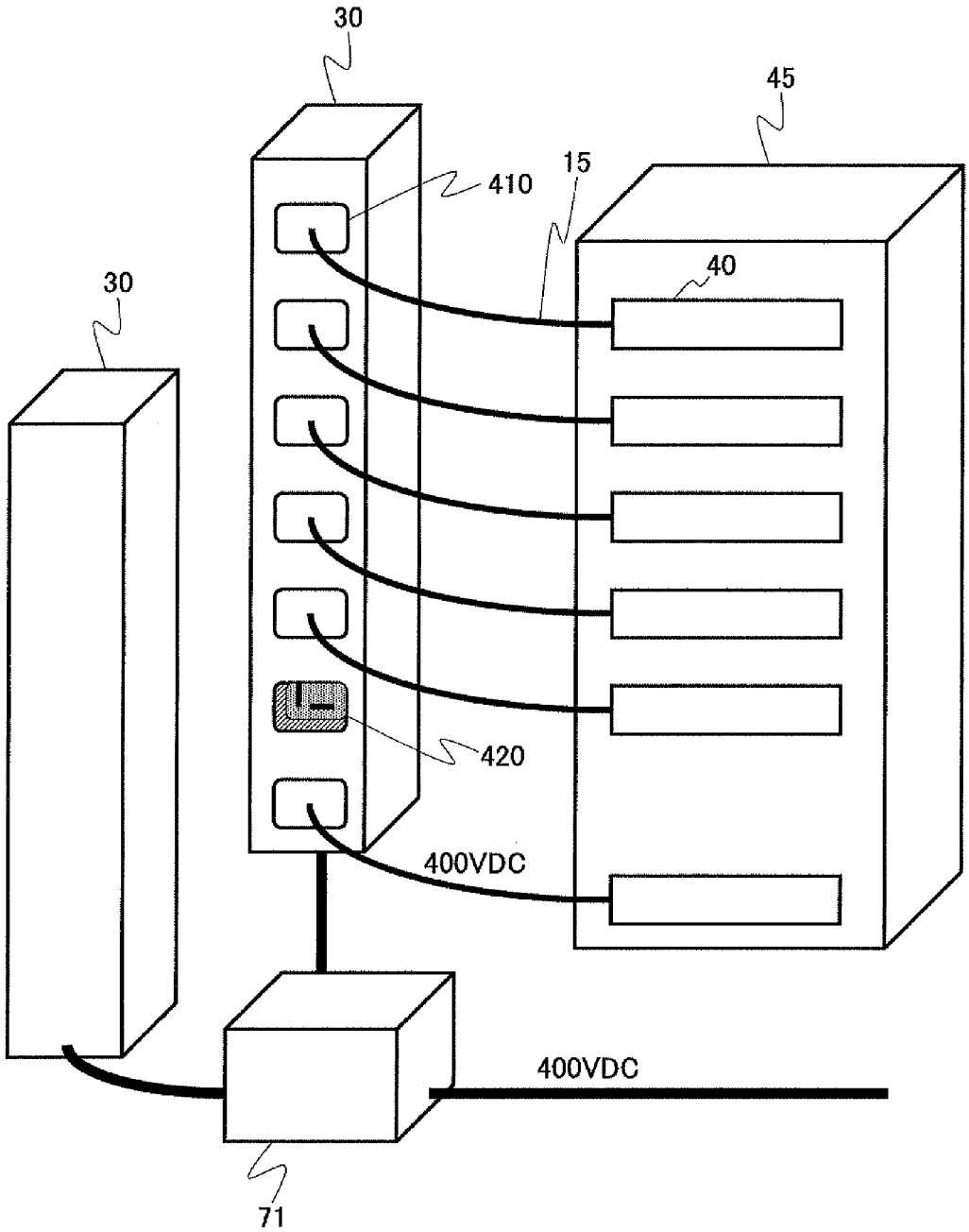
FIG. 21 is a perspective view of a power distribution unit using the connector unit according to the fourth embodiment of the present invention.

Next, a description is given, with reference to FIG. 21, of a power distribution unit (PDU) using the connector unit according to this embodiment. In FIG. 21, the same elements as those described above are referred to by the same reference numerals.

The electric power of 400 VDC supplied from the high-voltage power supply 50 illustrated in FIG. 20 is input to the distribution board 71, which distributes the input electric power to the PDUs 30. Each PDU 30 includes multiple female connectors 420 according to this embodiment, and can supply the 400 VDC electric power through each of the female connectors 420. On the other hand, the server rack 45 houses multiple information apparatuses 40 such as servers, which are connected to respective male connectors 410 for receiving a supply of electric power via power supply cables 15. The male connectors 410 are electrically connected to the corresponding female connectors 420 provided in the PDUs 30 so that the information apparatuses 40 are supplied with the 400 VDC electric power.

[e] Fifth Embodiment

Next, a description is given of a fifth embodiment according to the present invention. A male connector according to this embodiment may be configured to retract a control plug terminal with the restoring force of a helical torsion coil spring.

Figure 22A:
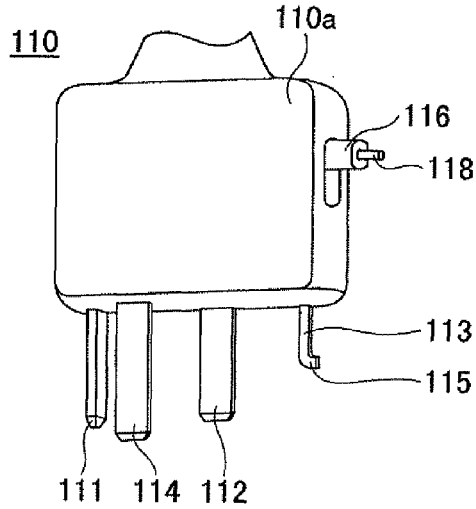
FIGS. 22A through 22C are perspective views of the exterior of a male connector according to a fifth embodiment of the present invention.
Figure 22B:
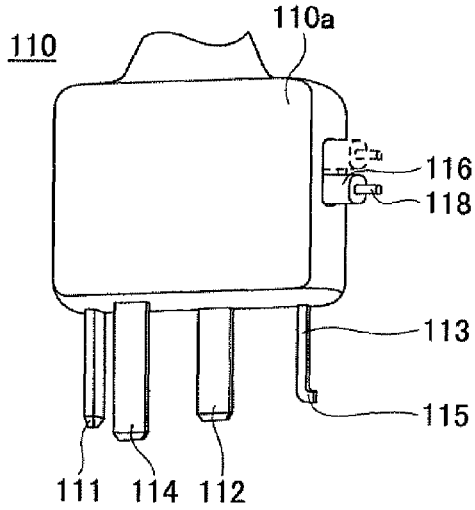
Figure 22C:
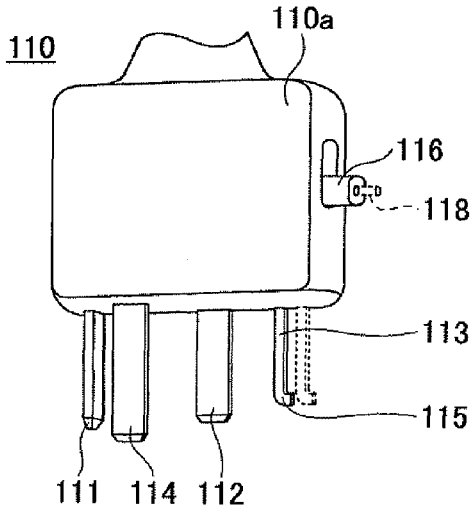

FIGS. 22A through 22C are diagrams illustrating a configuration of a male connector 110 according to this embodiment. FIG. 22A is a perspective view of the exterior of the male connector 110 with a control plug terminal 113 in a retracted state. FIG. 22B is a perspective view of the exterior of the male connector 110 with the control plug terminal 113 in an extended state. FIG. 22C is a perspective view of the exterior of the male connector 110 with the control plug terminal 113 in the extended state and a return button 118 in a pressed state.

The male connector 110 according to this embodiment includes two power plug terminals 111 and 112 for receiving a supply of electric power, the control plug terminal 113, a ground plug terminal 114 for grounding, a slide switch 116, and the return button 118. The control plug terminal 113 is configured to be movable back and forth relative to the insertion direction of the male connector 110 (in which the male connector 110 is inserted into a female connector) so as to extend in the insertion direction from a housing 110*a* of the male connector 110 and retract in the opposite direction (in which the male connector 110 is detached or removed from the female connector) into the housing 110*a*. The male connector 110 may further include the lock terminal 117 as illustrated in FIGS. 2A through 2C. The return button 118 protrudes from the opening of the slide switch 116 in a direction perpendicular to the insertion direction of the male connector 110. The return button 118 is urged in the protruding direction by an urging part (not graphically illustrated in FIGS. 22A through 22C).

Sliding the slide switch 116 in the insertion direction of the control plug terminal 113 from the position illustrated in FIG. 22A to the position illustrated in FIG. 22B causes the control plug terminal 113 to extend. Further, pressing the return button 118 from the position illustrated in FIG. 22B to the position illustrated in FIG. 22C causes the control plug terminal 113 to move in a direction perpendicular to the insertion direction.

Next, a description is given, with reference to FIGS. 23A through 23D, of the case of extending the control plug terminal 113 in the male connector 110 according to this embodiment. Extending the control plug terminal 113 causes two control electrodes provided at the control jack terminal of a female connector (not graphically illustrated) to change from an open (isolated) state to a closed (conducting) state.

Figure 23A:
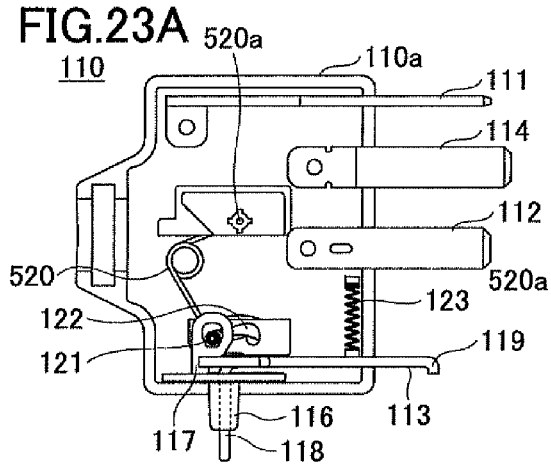
FIGS. 23A through 23F are diagrams illustrating the case of extending and retracting a control plug terminal of the male connector according to the fifth embodiment of the present invention.
Figure 23B:
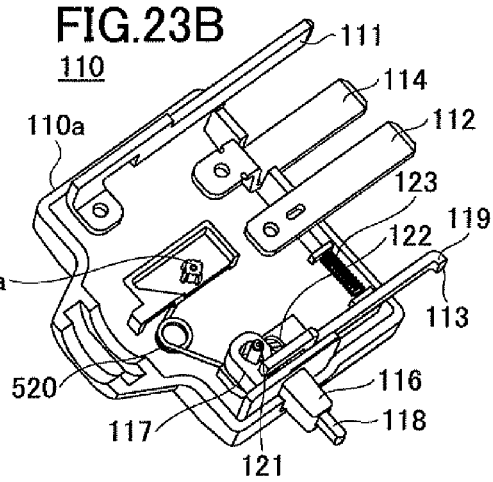

FIG. 23A is an internal structural view of the male connector 110 with the control plug terminal 113 in the retracted state. FIG. 23B is an inside perspective view of the male connector 110 with the control plug terminal 113 in the retracted state.

Figure 23C:
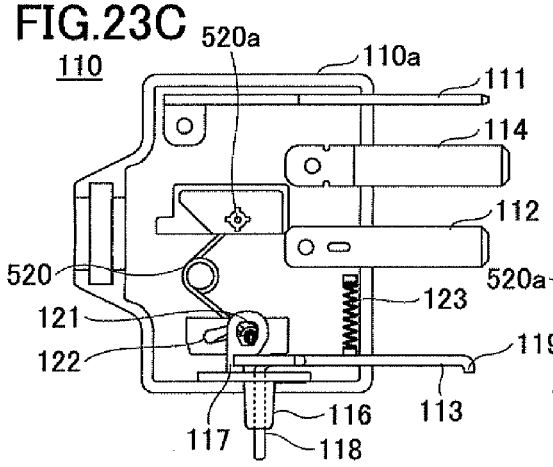
Figure 23D:
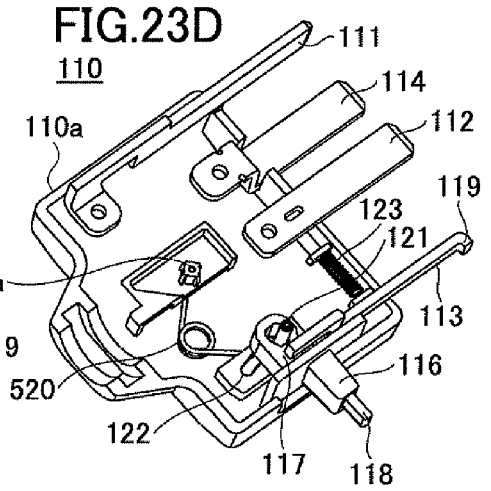

FIG. 23C is an internal structural view of the male connector 110 with the control plug terminal 113 in the extended state before the return button 118 is pressed. FIG. 23D is an inside perspective view of the male connector 110 with the control plug terminal 113 in the extended state before the return button 118 is pressed.

As illustrated in FIGS. 23A and 23B, the slide switch 116 is configured to cause the control plug terminal 113 to extend via the return button 118. A coil spring 123 is connected to the control plug terminal 113. The coil spring 123 is slightly compressed. The restoring force of the coil spring 123 urges the return button 118 in the protruding direction via the control plug terminal 113. According to this embodiment, the control plug terminal 113 and the return button 118 are formed as a unitary structure.

Further, a helical torsion coil spring 520 is provided inside the male connector 110. This helical torsion coil spring 520 has one end 520*a* rotatably supported by the housing 110*a* of the male connector 110 and has another end rotatably connected to a cam shaft 121. This cam shaft 121 is inserted in a cylindrical part 117 of the slide switch 116 and is movable inside a cam groove 122.

With the control plug terminal 113 in the retracted state, the slide switch 116 is positioned on the left side, and the cam shaft 121 is positioned furthest to the left inside the cam groove 122 to be in contact with the left-side inner wall surface of the cylindrical part 117 in FIG. 23A. At this point, the helical torsion coil spring 520 is slightly closed (bent) (that is, the legs of the helical torsion coil spring 520 are slightly closed) compared with its natural state.

Moving the slide switch 116 in the insertion direction (rightward in FIG. 23A) thereafter causes the control plug terminal 113 to be pushed to the right side by the return button 118 to move rightward, and causes the cam shaft 121 to be pushed to the right side by the cylindrical part 117 to move rightward in the cam groove 122. With this, the helical torsion coil spring 520 is further closed (bent). The restoring force of the helical torsion coil spring 520 is maximized immediately before the cam shaft 121 moves furthest to the right inside the cam groove 122. When the cam shaft 121 moves furthest to the right inside the cam groove 122, the helical torsion coil spring 520 is restored (opened) to the state illustrated in FIGS. 23C and 23D.

In this state, the slide switch 116 has moved to the right side and the control plug terminal 113 also has moved to the right side in FIG. 23C. Further, the cam shaft 121 has moved furthest to the right inside the cam groove 122 to be in contact with the right-side inner wall surface of the cylindrical part 117. At this point, the helical torsion coil spring 520 is slightly closed (bent) compared with its natural state.

Thereby, it is possible to extend the control plug terminal 113 in the insertion direction. This is performed against the restoring force of the helical torsion coil spring 520.

Next, a description is given, with reference to FIGS. 23A through 23F and FIG. 24, of the case of retracting the control plug terminal 113 in the male connector 110 according to this embodiment. Retracting the control plug terminal 113 causes the two control electrodes provided at the control jack terminal of the female connector (not graphically illustrated) to change from the closed (conducting) state to the open (isolated) state.

Figure 23E:
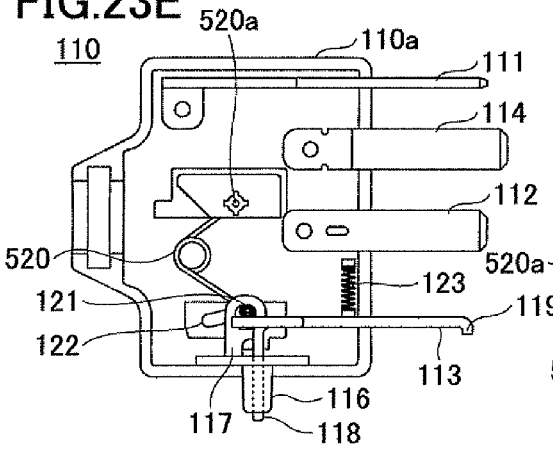
Figure 23F:
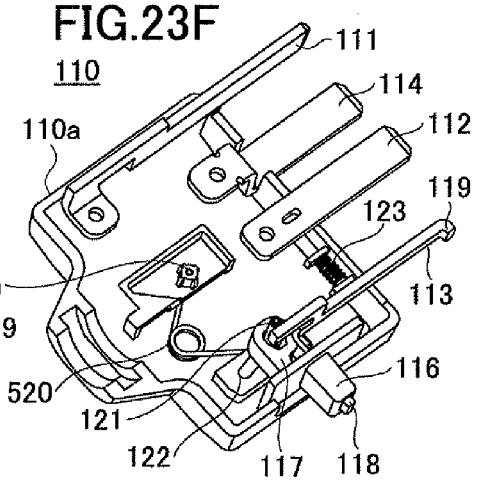
Figure 24:
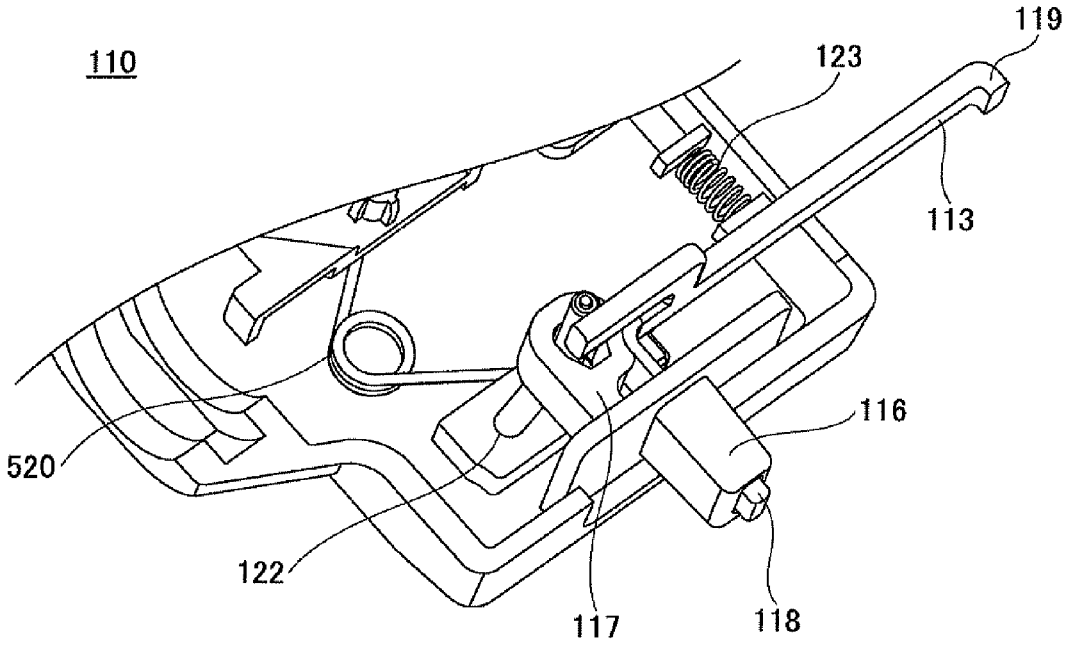
FIG. 24 is a perspective view of an internal structure of the male connector according to the fifth embodiment of the present invention.

FIG. 23E is an internal structural view of the male connector 110 with the control plug terminal 113 in the extended state and the return button 118 in the pressed state. FIG. 23F is an inside perspective view of the male connector 110 with the control plug terminal 113 in the extended state and the return button 118 in the pressed state. Further, FIG. 24 is an enlarged view of part of FIG. 23F.

As illustrated in FIGS. 23C and 23D, with the control plug terminal 113 in the extended state, the slide switch 116 is positioned on the right side, and the cam shaft 121 is positioned furthest to the right inside the cam groove 122 to be in contact with the right-side inner wall surface of the cylindrical part 117. At this point, the helical torsion coil spring 520 is slightly closed (bent) compared with its natural state.

Pressing the return button 118 thereafter brings about the state illustrated in FIGS. 23E and 23F.

In this state, the control plug terminal 113 is pushed to the upper side by the return button 118 to move upward in FIG. 23E while being in the extended state. At this point, the cam shaft 121 is pushed to the upper side by the side face of the control plug terminal 113 to move upward inside the cam groove 122. In this state, the helical torsion coil spring 520 is further closed (bent) compared with the state illustrated in FIGS. 23C and 23D, so that the restoring force of the helical torsion coil spring 520 is increased.

Thereafter, the opening restoring force of the helical torsion coil spring 520 causes the cam shaft 121 to move leftward inside the cam groove 122 in FIG. 23E to bring about the state illustrated in FIGS. 23A and 23B.

That is, the opening restoring force of the helical torsion coil spring 520 causes the cam shaft 121 to move leftward inside the cam groove 122 in FIG. 23E. As a result, the left-side inner wall surface of the cylindrical part 117 of the slide switch 116 is pressed, so that the control plug terminal 113 is retracted in the direction opposite to the insertion direction via the return button 118.

In this state, the slide switch 116 has moved to the left side and the control plug terminal 113 also has moved to the left side in FIG. 23A. Further, the cam shaft 121 has moved furthest to the left inside the cam groove 122 to be in contact with the left-side inner wall surface of the cylindrical part 117. At this point, the helical torsion coil spring 520 is slightly open compared with the state illustrated in FIGS. 23C and 23D.

Thereby, it is possible to retract the control plug terminal 113 in the direction opposite to the insertion direction. This is performed in a short period of time because the control plug terminal 113 is retracted in the direction opposite to the insertion direction by the restoring force of the helical torsion coil spring 520, that is, the opening force of the helical torsion coil spring 520.

In the case of a configuration without this helical torsion coil spring 520, the control plug terminal 113 would be retracted in the direction opposite to the insertion direction only with the force executed by a human finger. However, the speed of retraction differs depending on a person, and may be low.

In such a case, the low retraction speed of the control plug terminal 113 would cause an arc or chattering to be generated at the contacts of the female connector (not graphically illustrated) connected by this control plug terminal 113. Such generation of an arc or chattering would damage the contacts of the female connector or damage an apparatus connected to the male connector 110.

According to the male connector 110 of this embodiment, it is possible to retract the control plug terminal 113 in a short period of time. Accordingly, it is possible to reduce or prevent such generation of an arc or chattering, so that it is possible to reduce or prevent damage to the contacts of the female connector and to prevent damage to an apparatus connected to the male connector 110.

In this embodiment, a description is given of sliding forward and backward (extending and retracting) the control plug terminal 113 using the restoring force of the helical torsion coil spring 5202 that works in a direction to open (the legs of) the helical torsion coil spring 520 in a closed (bent) state. Alternatively, it is also possible to extend and retract the control plug terminal 113 in the same manner using the restoring force of the helical torsion coil spring 520 that works in a direction to close (bend) the helical torsion coil spring 520 in an open state by changing the structure of the cam groove 122, etc. Further, the helical torsion coil spring 520 used in this embodiment may be replaced with an elastic body of any configuration as long as the elastic body acts the same.

The male connector 110 of this embodiment may replace any of the male connectors 10 and 410 of the above-described embodiments. The male connector 110 and any of the female connectors 20, 120, 220, and 420 of the above-described embodiments may be combined to be used as a connector unit.

According to the male connector 110 of this embodiment, it is possible to retract the control plug terminal 113 by pressing the return button 118. Accordingly, it is possible to retract the control plug terminal 113 without moving the slide switch 116.

[f] Sixth Embodiment

Next, a description is given of a connector unit, a male connector, and a female connector according to a sixth embodiment of the present invention.

Figure 25:
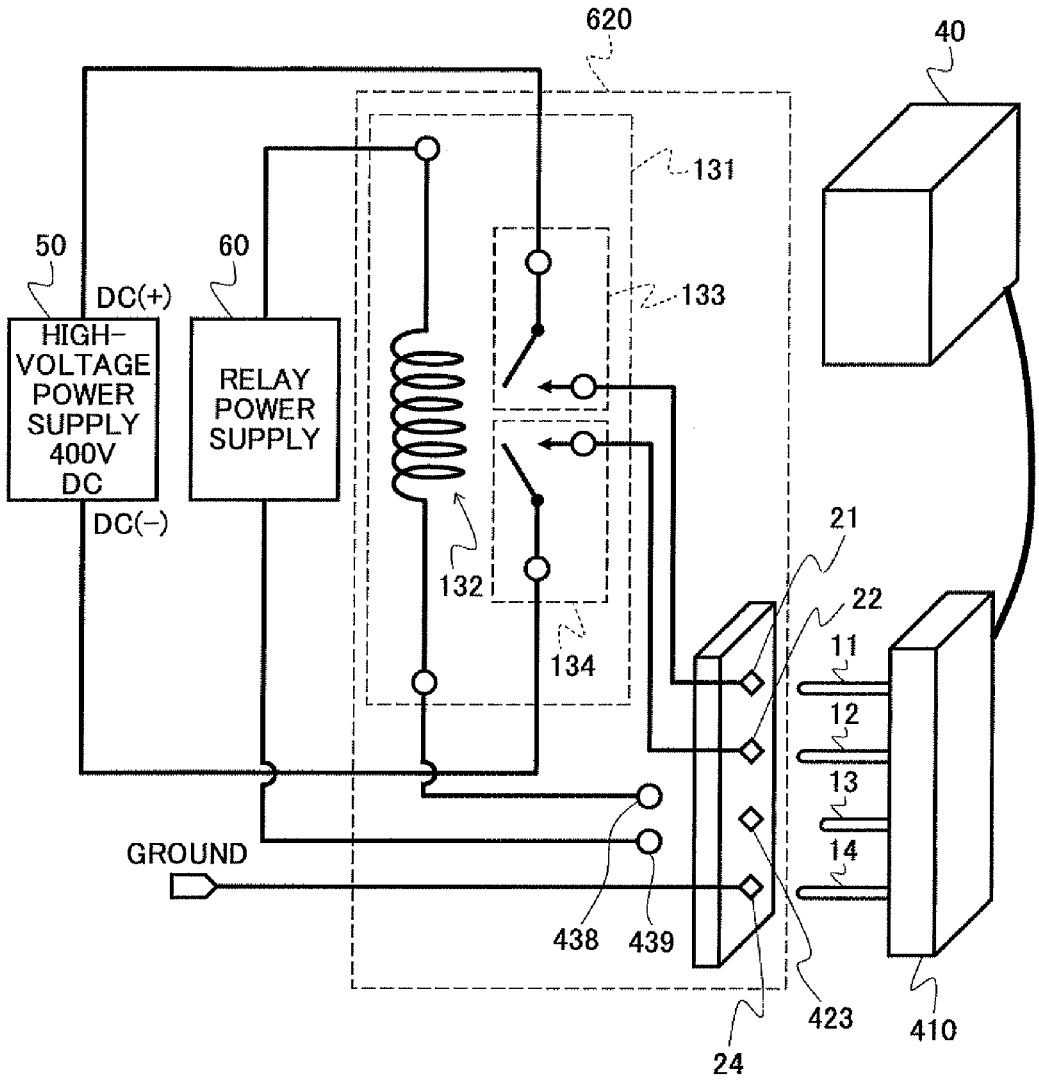
FIG. 25 is a diagram illustrating a configuration of a connector unit according to a sixth embodiment of the present invention.

FIG. 25 is a schematic diagram illustrating a configuration of a connector unit, a configuration of a male connector, and a configuration of a female connector according to this embodiment. In FIG. 25, the same elements as those described above are referred to by the same reference numerals.

Referring to FIG. 25, a connector unit according to this embodiment includes the male connector 410 and a female connector 620. The female connector 620 is connected to the high-voltage power supply 50 for supplying electric power. The female connector 620 includes the power jack terminals 21 and 22 corresponding to the power plug terminals 11 and 12, the control jack terminal 423 corresponding to the control plug terminal 13, and the ground jack terminal 24 corresponding to the ground plug terminal 14.

The female connector 620 further includes the relay 131 including the coil 132 and the relay contact pairs 133 and 134. By causing electric current to flow through the coil 132, each of the relay contact pairs 133 and 134 is closed to have its contacts connected. Without electric current flowing through the coil 132, each of the relay contact pairs 133 and 134 is open with its contacts separated (disconnected).

One of the contacts of the relay contact pair 133 is connected to the positive output of the high-voltage power supply 50, and the other one of the contacts of the relay contact pair 133 is connected to the power jack terminal 21. One of the contacts of the relay contact pair 134 is connected to the negative output of the high-voltage power supply 50, and the other one of the contacts of the relay contact pair 134 is connected to the power jack terminal 22.

The relay power supply 60 for driving the relay 131 is connected to the female connector 620. That is, one of the terminals of the coil 132 of the relay 131 is connected to one of the terminals of the relay power supply 60. Further, the other one of the terminals of the coil 132 is connected to the electrode 438, and the other one of the terminals of the relay power supply 60 is connected to the electrode 439.

As described above, the electrode 438 and the electrode 439 are electrically connected by extending the control plug terminal 13 of the male connector 410 in the insertion direction with the male connector 410 and the female connector 620 being fit to each other.

The electrodes 438 and 439 are thus electrically connected so that the electric current from the relay power supply 60 flows through the coil 132 to close the relay contact pairs 133 and 134 in the relay 131. As a result, the power jack terminals 21 and 22 of the female connector 620 are supplied with electric power, which is further supplied to the information apparatus 40 such as a server via the power plug terminals 11 and 12 of the male connector 410.

According to the connector unit of this embodiment, the relay contact pairs 133 and 134 of the relay 131 are connected to the power jack terminals 21 and 22, respectively. In the case of high-voltage DC electric power of a voltage exceeding 48 V, for example, a voltage higher than or equal to 200 V, contacting electricity is extremely dangerous to human bodies. Therefore, the relay contact pairs 133 and 134 are connected to the power jack terminals 21 and 22, respectively, to control electric power supply to the power jack terminals 21 and 22, thereby further increasing safety.

The connector unit of this embodiment may be used in the electric power supply system illustrated in FIG. 10 or FIG. 20.

Further, the male connector 410 of this embodiment may be replaced with the male connector 110 of the fifth embodiment.

According to this embodiment, the relay 131 is provided inside the body of the female connector 620. Alternatively, the relay 131 may also be provided external to the female connector 620.

The above description is given of the cases of 400 VDC. However, the above-described connector units, male connectors, and female connectors are applicable to any case of direct current (DC). Unlike in the case of AC, no frequencies are safe for human bodies in the case of DC.

Further, in light of influence on human bodies, voltages lower than or equal to 48 V are normally used as direct-current voltage. This is because usually, human bodies are almost immune to electric shock if the voltage is lower than or equal to 48 V. On the other hand, the influence on human bodies is significant if the voltage exceeds 48 V, and voltages higher than or equal to 200 V are particularly dangerous.

The above-described connector units, male connectors, and female connectors have increased safety, and produce remarkable effects particularly in the case of voltages exceeding 48 V, for example, voltages higher than or equal to 200 V. That is, the above-described connector units, male connectors, and female connectors have their safety increased with configurations different from the conventional ones so as to have increased safety with respect to voltages exceeding 48 V, for example, voltages higher than or equal to 200 V, as well. As a result, the above-described connector units, male connectors, and female connectors produce remarkable effects particularly in the case of voltages exceeding 48 V, for example, voltages higher than or equal to 200 V.

Thus, according to one aspect of the present invention, it is possible to provide a connector unit and a male connector that are capable of providing high-voltage electric power with safety.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. A connector unit for electrically connecting a power supply and an electronic apparatus to be supplied with electric power from the power supply, the connector unit comprising:

a male connector to be connected to the electronic apparatus, the male connector including a pair of power plug terminals of conductors for receiving the electric power;

a control plug terminal;

a slide switch for moving the control plug terminal between a first position and a second position in a first direction;

a return button protruding from an opening of the slide switch in a second direction perpendicular to the first direction;

an urging part configured to urge the return button in the second direction; and an elastic member; and a female connector to be connected to the power supply, the female connector including a pair of power jack terminals corresponding to the power plug terminals; and a control jack terminal corresponding to the control plug terminal and including a control switch, wherein the control plug terminal is configured to cause contacts of the control switch of the control jack terminal to be connected to allow the electric power to be supplied to the electronic apparatus, by being moved to the first position with the power plug terminals being fit into the jack plug terminals, and the return button is configured to cause the elastic member to deform via the control plug terminal by being pressed with the control plug terminal at the first position, so that the control plug terminal is moved to the second position with a restoring force of the elastic member.

2. The connector unit as claimed in claim 1, wherein the female connector further includes an insulator spring having a protruding part protruding parallel to the first direction, the insulator spring being provided between the control switch and the control plug terminal, the control switch being a metal leaf-spring switch, the control plug terminal is configured to press the protruding part of the insulator spring so that the insulator spring bends to connect the contacts of the control switch, by being moved to the first position with the power plug terminals being fit into the jack plug terminals, and the return button is configured to cause the control plug terminal to move in a third direction opposite to the second direction to be detached from the protruding part so that the insulator spring is elastically restored to separate the contacts of the control switch, by being pressed with the control plug terminal pressing the protruding part with the power plug terminals being fit into the jack plug terminals.

3. The connector unit as claimed in claim 1, wherein the male connector further includes a ground plug terminal, the female connector further includes a ground jack terminal corresponding to the ground plug terminal, and the ground plug terminal and the ground jack terminal are configured to be fit to each other with the male connector being fit into the female connector.

4. The connector unit as claimed in claim 1, wherein the electric power is supplied from the power supply by direct current.

5. The connector unit as claimed in claim 1, wherein a voltage of the electric power supplied from the power supply exceeds 48 V.

6. A male connector configured to be connected to an electronic apparatus and a female connector to be connected to a power supply, in order to electrically connect the power supply and the electronic apparatus to be supplied with electric power from the power supply, the male connector comprising:

a pair of power plug terminals of conductors for receiving the electric power;

a control plug terminal;

a slide switch for moving the control plug terminal between a first position and a second position in a first direction;

a return button protruding from an opening of the slide switch in a second direction perpendicular to the first direction;

an urging part configured to urge the return button in the second direction; and an elastic member, wherein the control plug terminal is configured to cause contacts of a control switch of a control jack terminal of the female connector to be connected to allow the electric power to be supplied to the electronic apparatus, by being moved to the first position with the power plug terminals being fit into jack plug terminals of the female connector, and the return button is configured to cause the elastic member to deform via the control plug terminal by being pressed with the control plug terminal at the first position, so that the control plug terminal is moved to the second position with a restoring force of the elastic member.

7. The male connector as claimed in claim 6, wherein the control plug terminal is configured to press a protruding part of an insulator spring of the female connector so that the insulator spring bends to connect the contacts of the control switch, by being moved to the first position with the power plug terminals being fit into the jack plug terminals, the protruding part protruding parallel to the first direction, the insulator spring being provided between the control switch and the control plug terminal, the control switch being a metal leaf-spring switch, and the return button is configured to cause the control plug terminal to move in a third direction opposite to the second direction to be detached from the protruding part so that the insulator spring is elastically restored to separate the contacts of the control switch, by being pressed with the control plug terminal pressing the protruding part with the power plug terminals being fit into the jack plug terminals.

8. The male connector as claimed in claim further comprising:

a ground plug terminal configured to fit into a ground jack terminal of the female connector with the male connector being fit into the female connector.

9. The male connector as claimed in claim 6, wherein the electric power is supplied from the power supply by direct current.

10. The male connector as claimed in claim 6, wherein a voltage of the electric power supplied from the power supply exceeds 48 V.

* * * * *